US008590121B1

(12) United States Patent
Patt, Jr. et al.

(10) Patent No.: US 8,590,121 B1
(45) Date of Patent: Nov. 26, 2013

(54) ELASTOMERIC FASTENER

(75) Inventors: Douglas Charles Patt, Jr., Allentown, PA (US); Brian Benjamin Witlin, Menlo Park, CA (US)

(73) Assignee: Jibbitz, LLC, Niwot, CO (US)

( * ) Notice: Subject to any disclaimer, the term of this patent is extended or adjusted under 35 U.S.C. 154(b) by 527 days.

(21) Appl. No.: 11/530,005

(22) Filed: Sep. 7, 2006

Related U.S. Application Data

(60) Provisional application No. 60/714,664, filed on Sep. 7, 2005, provisional application No. 60/728,249, filed on Oct. 18, 2005, provisional application No. 60/728,081, filed on Oct. 18, 2005, provisional application No. 60/728,669, filed on Oct. 19, 2005, provisional application No. 60/729,433, filed on Oct. 20, 2005.

(51) Int. Cl.
*A43C 1/02* (2006.01)
*A43B 9/00* (2006.01)

(52) U.S. Cl.
USPC ..... 24/713.1; 36/51

(58) Field of Classification Search
USPC ..... 24/713.1, DIG. 37; 36/51
See application file for complete search history.

(56) References Cited

U.S. PATENT DOCUMENTS

| | | | | |
|---|---|---|---|---|
| 39,163 | A | | 7/1863 | Newton |
| 494,825 | A | | 4/1893 | Spicer |
| 1,486,138 | A | | 3/1924 | Hanson |
| 1,673,080 | A | * | 6/1928 | Lamy ..... 24/715.3 |
| 1,772,238 | A | * | 8/1930 | Bonne ..... 24/575.1 |
| 1,772,673 | A | | 8/1930 | MacDonald |
| 2,004,702 | A | * | 6/1935 | Luttmann, Jr. ..... 24/713.1 |
| 2,289,225 | A | | 7/1942 | Tonai |
| 3,382,546 | A | * | 5/1968 | Palmay et al. ..... 24/114.7 |
| 3,701,572 | A | * | 10/1972 | Velasquez ..... 24/712.4 |
| 3,931,686 | A | | 1/1976 | Rathbun |
| 4,094,029 | A | | 6/1978 | Carlile |
| 4,144,621 | A | * | 3/1979 | Green ..... 24/300 |
| 4,210,983 | A | * | 7/1980 | Green ..... 24/575.1 |
| 4,229,930 | A | | 10/1980 | Ostermaier |
| 4,296,515 | A | | 10/1981 | Hauser |
| 4,545,138 | A | | 10/1985 | Blum |
| 4,597,197 | A | | 7/1986 | Strasinger |
| 4,631,840 | A | | 12/1986 | Gamm |
| 4,642,914 | A | | 2/1987 | Caldeira |
| 4,697,362 | A | | 10/1987 | Wasserman |
| 4,733,439 | A | * | 3/1988 | Gentry ..... 206/338 |
| 4,777,705 | A | | 10/1988 | Ingram |
| 4,870,761 | A | | 10/1989 | Tracy |
| 4,897,947 | A | | 2/1990 | Kass-Pious |
| 4,958,459 | A | | 9/1990 | Davidson |
| 5,165,190 | A | | 11/1992 | Smyth |
| 5,214,826 | A | | 6/1993 | Fortune |
| 5,226,246 | A | | 7/1993 | Soo |
| 5,230,171 | A | | 7/1993 | Cardaropoli |
| 5,239,732 | A | | 8/1993 | Steven |
| 5,295,315 | A | | 3/1994 | Osawa et al. |
| 5,388,315 | A | * | 2/1995 | Jones ..... 24/712.1 |
| 5,412,852 | A | | 5/1995 | Smaragdas |
| 5,456,032 | A | | 10/1995 | Matsumoto et al. |

(Continued)

*Primary Examiner* — Robert J Sandy
(74) *Attorney, Agent, or Firm* — Faegre Baker Daniels LLP

(57) ABSTRACT

An elastomeric fastener is configured for securing various articles. The elastomeric fasteners include one or more locking mechanisms. In various embodiments, the elastomeric fasteners are configured to secure an article of clothing, such as a shoe. The elastomeric fasteners may be used in combination to form an image.

38 Claims, 17 Drawing Sheets

(56) References Cited

U.S. PATENT DOCUMENTS

| | | | | | |
|---|---|---|---|---|---|
| 5,657,557 | A | | 8/1997 | Hull et al. | |
| 5,669,116 | A | | 9/1997 | Jungkind | |
| 5,692,276 | A | | 12/1997 | Paxton | |
| 5,737,811 | A | | 4/1998 | Rashid | |
| 5,746,500 | A | | 5/1998 | Chien | |
| 5,822,844 | A | * | 10/1998 | Mento | 24/575.1 |
| 5,845,422 | A | | 12/1998 | Valteau, III | |
| 5,857,220 | A | | 1/1999 | Erny et al. | |
| 5,879,069 | A | | 3/1999 | Chien | |
| 6,030,089 | A | | 2/2000 | Parker et al. | |
| 6,112,380 | A | | 9/2000 | Dolan et al. | |
| 6,278,378 | B1 | | 8/2001 | Feiner et al. | |
| 6,312,782 | B1 | | 11/2001 | Goldberg et al. | |
| 6,357,093 | B1 | | 3/2002 | Takahashi | |
| 6,412,151 | B1 | | 7/2002 | Rowland | |
| 6,470,601 | B1 | | 10/2002 | Zane | |
| 6,513,210 | B1 | | 2/2003 | Gonzalez | |
| 6,536,139 | B2 | | 3/2003 | Darley et al. | |
| 6,622,357 | B2 | | 9/2003 | Jackson et al. | |
| 6,684,543 | B2 | | 2/2004 | Fernau | |
| 6,701,589 | B1 | | 3/2004 | Kliewer | |
| 6,968,638 | B2 | * | 11/2005 | Gonzalez Palacio | 24/713.1 |
| 2001/0004808 | A1 | | 6/2001 | Hurwitz | |
| 2002/0109981 | A1 | | 8/2002 | Amici | |
| 2002/0194748 | A1 | | 12/2002 | Jackson et al. | |
| 2003/0136026 | A1 | | 7/2003 | Crary | |
| 2005/0016032 | A1 | | 1/2005 | Cox et al. | |

* cited by examiner

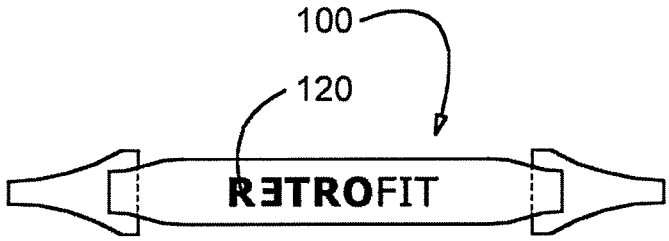
FIG 1A
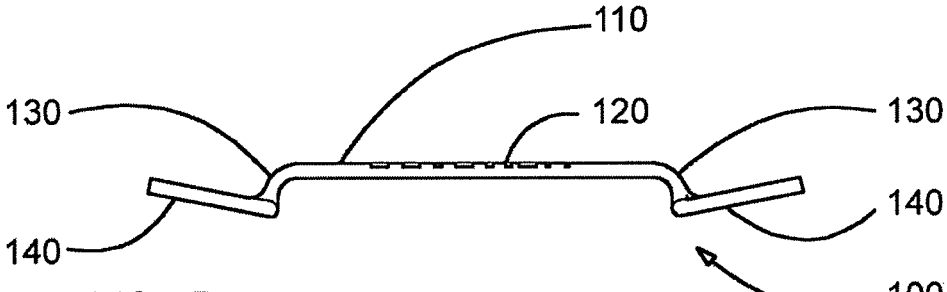
FIG 1B
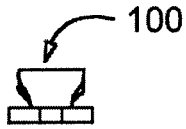
FIG 1C
FIGURE 1

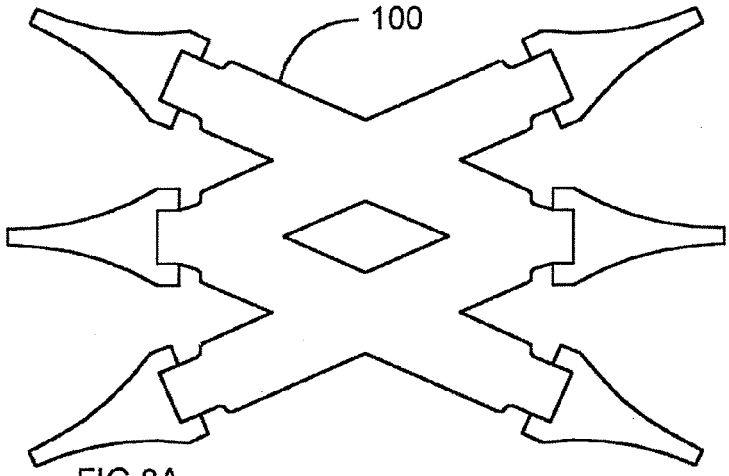
FIG 8A
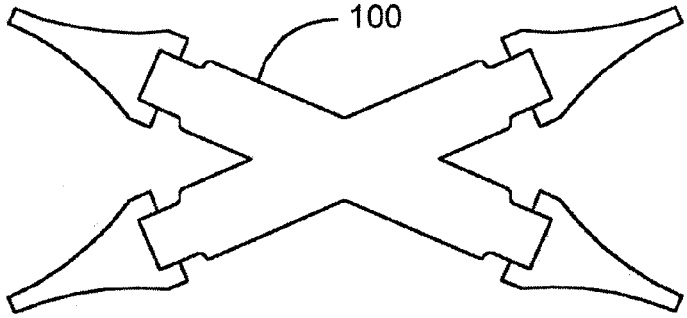
FIG 8B
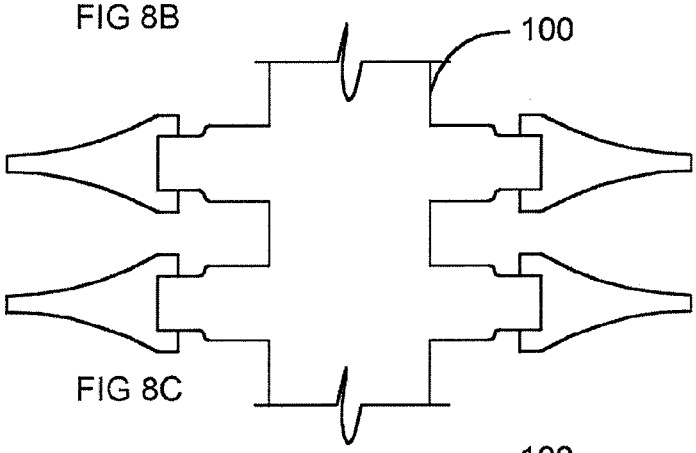
FIG 8C
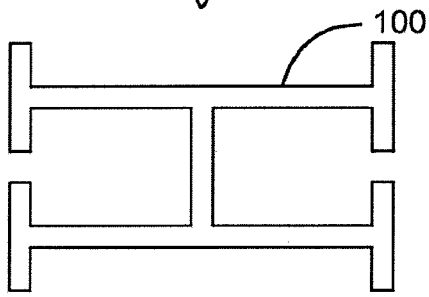
FIG 8D
FIGURE 8

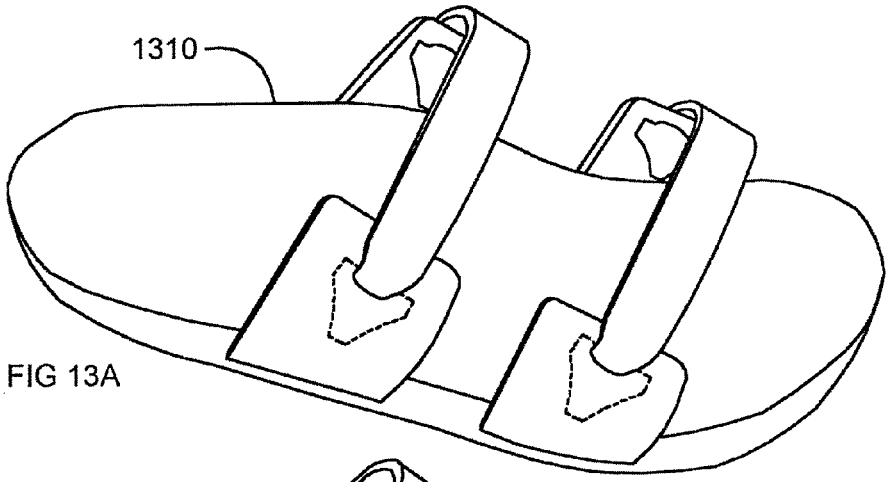
FIG 13A
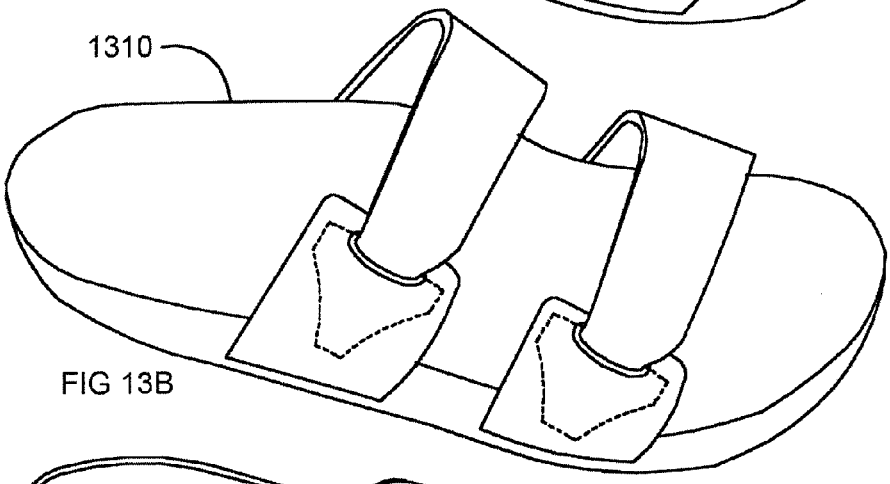
FIG 13B
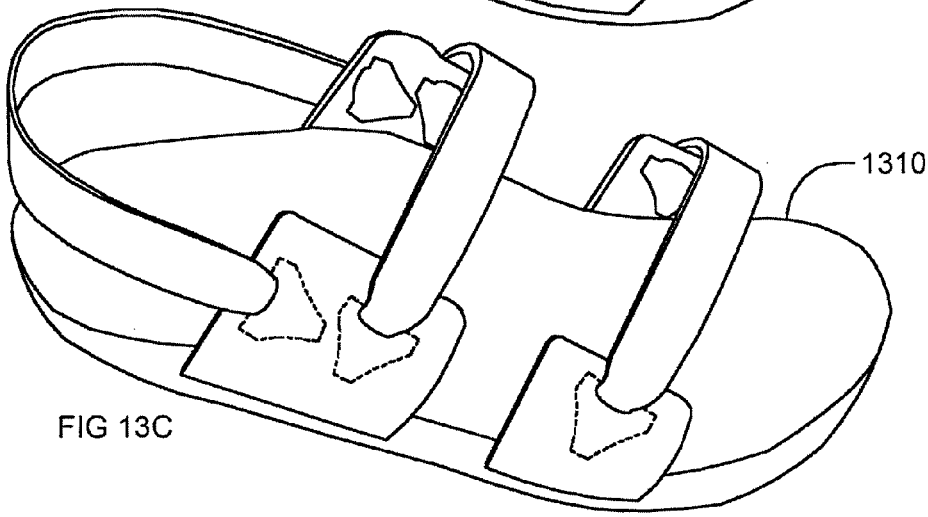
FIG 13C
FIGURE 13

ELASTOMERIC FASTENER

CROSS-REFERENCE TO RELATED APPLICATIONS

This application claims benefit of and priority to U.S. Provisional Patent Applications: 60/714,664 filed Sep. 7, 2005; 60/728,249 filed Oct. 18, 2005; 60/728,081 filed Oct. 18, 2005; 60/728,669 filed Oct. 19, 2005; and 60/729,433 filed Oct. 20, 2005. The disclosures of the above provisional patent applications are hereby incorporated herein by reference.

BACKGROUND

1. Field of the Invention

The invention is in the field of fasteners and, in particular, fasteners for use in apparel and other applications.

2. Related Art

The use of laces, buttons, snaps, zipper and Velcro™ as fasteners for appear are well known. For example, footwear commonly includes laces, zippers and Velcro™.

SUMMARY

Various embodiments of the invention include an elastomeric fastener composed of at least partially of one or more elastomeric substances, so that the elastomeric fastener may be stretched. The elasticity of the fastener may be varied. The variation of elasticity may be carried out by changing the elastomeric substance or substances used in the elastomeric fastener. Variation of the elasticity may render different elastomeric fasteners suitable for use in different circumstances.

Optionally, the elastomeric fastener includes a locking mechanism (coupling) for inserting through an eyelet of a shoe. The locking mechanism may include connectors operable to hold and/or lock the elastomeric fastener into the eyelet of the shoe. The locking mechanism may be shaped as an arrow, a bar, a cone, and/or a metal clip. The locking mechanism may be composed at least partially of an elastomeric substance. The locking mechanism may also be made of the same material as the elastomeric fastener. The locking mechanism may also be co-molded to the elastomeric fastener with a different material than the elastomeric fastener.

In various embodiments, the elastomeric fastener is configured to display advertising, logos, or writing on the surface of the fastener. Customization of the elastomeric fastener may include an indentation in the surface, stamping entirely through the elastomeric fastener, printing on both sides of the elastomeric fastener, and/or the like. The elastomeric fastener may have multiple colors either on one side of the fastener or on different sides of the fastener. The elastomeric fastener may have a buckle or latch displayed on the main body of the elastomeric fastener.

Various embodiments of the invention include a method of inserting a elastomeric fastener into preexisting shoe eyelets, where the elastomeric fastener is stretched as it is inserted into one or more eyelets. Either the body of the elastomeric fastener, or the locking mechanisms on the elastomeric fastener, or both the body and the locking mechanisms may be stretched as the elastomeric fastener is inserted into one or more eyelets. The elastomeric fastener remains in a stretched position when locked into the eyelets. The elastomeric fastener may be inserted into the eyelets by hand or by machine.

Various embodiments of the invention include an elastomeric fastener system comprising a body including an elastomeric material configured to stretch so as to secure an article of footwear to a foot, a first locking mechanism disposed at a first end of the body and configured to attach to the article of footwear, and a second locking mechanism disposed at a second end of the body and configured to be attached and detached from the article of footwear by a user by passing the second locking mechanism through an opening in the footwear.

Various embodiments of the invention include an elastomeric fastener system comprising a body including an elastomeric material configured to stretch so as to secure an article of clothing, a first locking mechanism disposed at a first end of the body and configured to attach to the article of clothing, and a second locking mechanism disposed at a second end of the body and configured to be attached and detached from the article of clothing by a user, the second locking mechanism including a triangular element configured to pass through an eyelet.

Various embodiments of the invention include an elastomeric fastener system comprising a first elastomeric fastener comprising a first body including an elastomeric material configured to stretch so as to secure an article of footwear to a foot, a first locking mechanism attached to the first body and configured to attach to the article of footwear, and a second locking mechanism attached to the first body and configured to be attached and detached from the article of footwear by a user; and a second elastomeric fastener comprising a second body including an elastomeric material configured to stretch so as to secure the article of footwear to a foot, third first locking mechanism attached to the second body and configured to attach to the article of footwear, and a second locking mechanism attached to the second body and configured to be attached and detached from the article of footwear by the user by passing the second locking mechanism through an opening in the footwear.

BRIEF DESCRIPTION OF THE DRAWINGS

FIGS. 1A-1C illustrate an elastomeric fastener, according to various embodiments of the invention.

FIGS. 8A-8D illustrate various embodiments of the elastomeric fastener configured to attach to more than one eyelet of a shoe.

FIGS. 13A-13B illustrates use of an elastomeric fastener in a sandal, according to various embodiments of the invention.

DETAILED DESCRIPTION

Figure 2:
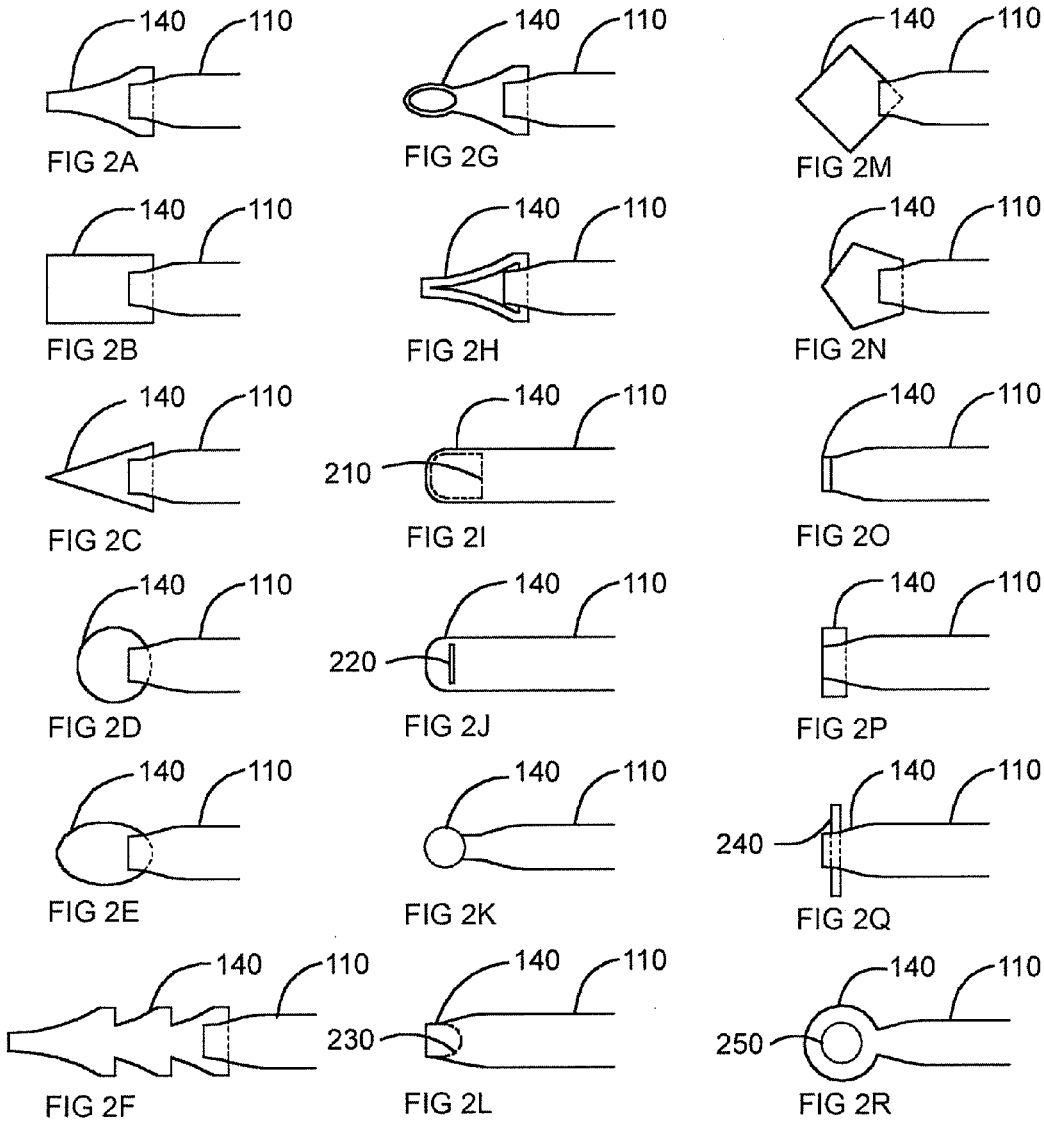
FIGS. 2A-2R illustrate plan view of various alternative configurations of the elastomeric fastener, according to various embodiments of the invention.

Various embodiments of the invention include an elastomeric fastener composed of one or more elastomeric substances configured such that the elastomeric fastener may be stretched. For example, in various embodiments the elastomeric fastener is configured to be stretched by at least 5, 10, 15, 20, 30 or 50 percent. As is described further herein, the elastomeric fastener may be used in a variety of applications includes fastening footwear. The elasticity of the fastener may be varied by changing the elastomeric substance or other substances used in the elastomeric fastener. Additionally, the desired tension across the face of a shoe, or other article, may be controlled by changing the length of the body of the fastener. Variation of the elasticity and length may render different elastomeric fasteners suitable for use in different circumstances.

In various embodiments, the body of the fastener includes a rectangular shape at least 1, 1.25 1.5, 2, or 2.25 inches long and approximately 0.25, 0.375, 0.5, or 0.625 inches wide. At each end, the rectangular shape narrows toward the curved, down-turning portions at both sides and finally terminates at a triangular coupling. A desired tension is achieved by choosing an appropriate length of the rectangular shape relative to coupling points of an article, a variation in material durometer, or by varying the sectional thickness of the rectangular shape. For example, if the coupling points include the eyelets of a shoe, a desired tension across the face of the shoe is achieved by choosing a length that results in an appropriate stretching of the elastomeric fastener when the elastomeric fastener is attached between the eyelets. This tension may affect performance as well as the ease by which the shoe is taken on and off.

The body of the elastomeric fastener may take on a variety of widths, lengths and configurations depending upon aesthetic and functional requirements. These variations are illustrated further in the figures. In some embodiments, the body of the fastener is the point at which the fasteners' elastic properties are most critical.

The elasticity of the fastener can be affected by material choice and the desired tension across the face of the shoe is affected by the length of the body of the fastener and its thickness. For example, athletes may prefer a shoe that is fixed very tight to the foot and feels as though it is part of the body. Alternatively, someone that wears a shoe for comfort, short periods of time or in a location that dictates different shoes over the course of a day may desire a shoe that is loose fitting and easily taken on and off. Some embodiments included an elastomeric fastener that may be manufactured in different configurations of material and fastener body length to achieve different function.

In some embodiments, the ends of the elastomeric fastener are approximately 1" long and 9/16" wide. They are triangular in shape with the backside of the triangle meeting the body of the fastener at both sides. The triangular ends are shaped such that the narrow 3/32" wide portion can be passed through the eyelet of a shoe. The triangular ends are optionally configured such that it is easy to grab, pass through the eyelet of a shoe and may readily be pulled. This pulling action may be facilitated by a slight radius in the long arms of the triangular ends that help the ends pass through the eyelets of the shoe. Once the ends have been pulled through the eyelet, the elastomeric fastener locks into place due to the change in dimension from the triangular end and the curved, down-turning portion that transitions from the body of the fastener. The triangular ends include alternate widths and configurations. However, the ends are typically narrow enough to pass through the eyelet and wide enough at the backside to enable proper locking (coupling) beyond the eyelet of the shoe.

In some embodiments, the elastomeric fastener is configured for use such that the ends pass into an eyelet and are then hidden under the surface of a shoe. In other embodiments, the triangular end (or any other end shape configuration that allows locking and passing through the eyelet) is configured to come up through the eyelet and be locked above the surface of the shoe. In these embodiments, part of the rectangular region may be disposed below the surface of the shoe as the rectangular region passes across the shoe. In some embodiments, the elastomeric fastener is configured to fit through a loop in a tough of a shoe.

The elastomeric fastener locks into place on a shoe because the backside of the triangular end is wider than the typical eyelet of a shoe. Just beyond the triangular end at both sides of the fastener is a curved, down-turning (up-turning coming from triangular end) portion that transitions to the body of the fastener. This curve is the transition point from the triangular end to the body of the fastener and the location the fastener rests in the eyelet. In some embodiments, this curve is configured such that there is a 7/32" wide section that is 3/32" thick and transitions to the body of the fastener in the shape of a reverse curve when viewed from the top. This reverse curve allows a smooth visual transition to the elastomeric fastener when stretched across the front of the shoe. The elastomeric fastener at this location is wide enough to pass through the eyelet of a shoe while, in some embodiments, creating some friction at the eyelet when the fastener is in place. In some embodiments, the elastomeric fastener is also configured to create a slight reveal in its surface because of its width that is much like the appearance of a typical shoelace.

The elastomeric fastener may be made of any elastic material that provides a desired performance and fit. A variety of different types of silicone, rubber, castable polyurethane (CPU), Thermoplastic Elastomer (TPU, TPE), or any other elastic material, may be chosen based on their properties, the variety of which are consistent and known to those manufacturers that supply such. The elastomeric fastener may also be composed of more than one type of each particular material, depending upon the desired elasticity and configuration. The elastomeric fastener may also be composed of some of the materials mentioned herein as well as non-elastic material or materials that have different elastic qualities but serve a purpose such as adding durability to the elastomeric fastener. The elastomeric fastener may also be composed of some of the above-mentioned materials in addition to substantially different materials that have elastic qualities such as a plastic or metal spring. A spring may be added in place of such elastic materials to add resiliency and tension as well as desired aesthetic qualities.

The fastener may be composed in part of materials that are not elastic in order to allow the fastener to be more rigid, more durable, or more easily grabbed in particular locations. The fastener end may be altered such that the terminus of the triangular end may be composed of plastic, metal, adhesives, or any other variety of materials that facilitate gripping. The end may also be configured such that the terminus is a variety of shapes, such as a sphere or elliptical object that appears to be integrated into the fastener. The object may be narrow enough to pass through the eyelet of a shoe but wide enough to be grabbed and pulled.

The transitions of form and shape that occur along the elastomeric fastener's length are particularly prone to damage and tear because of the forces that are intrinsic to this type of object. Therefore, a material other than an elastomer may be added to areas such as the outside edges of the notches in the fastener, triangular ends of the fastener, or in the transitional curved portion between the body and the ends. This may maintain elasticity at the body as well as protection to critical areas along the length of the fastener.

In some embodiments, the elastomeric fastener is to be altered such that it is molded to accommodate other materials that simply slide in place on the elastomeric fastener and are fixed. Other embodiments include co-molding an alternate material with the elastic material of the elastomeric fastener to form a unified object. The elastomeric fastener may be made in a pouring process whereby hot rubber, silicone, castable polyurethane (CPU), Thermoplastic Elastomer (TPU, TPE) or alternate elastic materials are poured in a custom mold. The elastomeric fastener may also be injection molded whereby substances such as Thermoplastic Elastomer (TPU, TPE) or alternate elastic materials are molded through injection into a custom mold. In various embodiments, the elastomeric fastener is made by stamping hot rubber, silicone, castable polyurethane (CPU), Thermoplastic Elastomer (TPU, TPE), or alternate elastic materials using a custom mold.

In various embodiments, the elastomeric fastener includes a locking mechanism (e.g. coupler) configured for inserting through an eyelet of a shoe. The locking mechanism can include connectors operable to hold and/or lock the elastomeric fastener into the eyelet of the shoe. The locking mechanism may include a shape such as an arrow, a bar, a cone, any other alternate shape designed for eyelet insertion, or an operable physical mechanism such as a clip or clasp. The locking mechanism may be composed at least partially of an elastomeric substance. The locking mechanism may be made of the same material as other parts of the elastomeric fastener, partially of the material of the elastomeric fastener or a completely different material. The locking mechanism may also be co-molded or fitted to the elastomeric fastener with a different material than the elastomeric fastener.

The locking mechanism of the elastomeric fastener may take on a variety of shapes. In some embodiments, critical factors determining these shapes include: an aesthetic appeal; an ability to be passed through the eyelet of a shoe; an ability to lock into place once pulled through the eyelet; a subjective 'feel' of the lace once inserted in the shoe; and a durability of the locking mechanism and adjacent materials.

The locking mechanism of the elastomeric fastener is optionally found at both ends of the elastomeric fastener. The locking mechanism may include a variety of shapes, most of which have the ability to pass through the eyelet of a particular shoe. Some locking mechanism shapes may work better in some applications than others. For example, a particular shape may be preferred for a particular type of shoe eyelet. The locking mechanism may be triangular in plan and flat in section, or may be some variation of this triangular shape so that its section is circular or ovular. The locking mechanism may also be spherical or elliptical in plan and section or some geometrical hybrid of the above mentioned. However, the locking mechanism is typically dimensioned such that it can be passed and pulled through an eyelet. The locking mechanism shape may also be a function of the partially subjective determination on the part of the shoe wearer as to the 'feel' of the product once in place inside the shoe. In a one embodiment, the locking mechanism preferably fits between the top of the shoe and the tongue while not creating a protrusion that will be uncomfortable to the wearer.

In those embodiments including a triangular locking mechanism, the sides of the triangle may be straight or curved and of lengths deemed functional and comfortable for the wearer. The backside of the triangular end coincides with the curve and/or body of the elastomeric fastener. The backside is normally wider than the eyelet of the shoe in order for the locking mechanism to lock into place. The elastomeric fastener locks into place because it expands once it has passed fully through the eyelet. In order to function properly, the fastener should stay locked into place in at least one location as it is stretched across the top of the shoe and locked into place at the opposite side or any other location deemed functional.

In other embodiments, the locking mechanism includes other shapes that can be manipulated such that its size once rotated, pressed or squeezed allows it to be passed through an eyelet. These shapes may include, for example, a bar with flat sectional qualities or a rod with circular sectional qualities. If the bar or rod is constructed of an elastic malleable material the ends can be squeezed together and passed through an eyelet. The locking mechanism may also include shapes that are rigid and must be passed fully through the eyelet to create a locked position. If the bar or rod is not malleable, it may alternately be fed through an eyelet and rotated to lock in place, or the eyelet may include the malleable feature. This in turn makes the connecting portion of the notch or body of the fastener deform and/or stretch slightly, which in turn allows the bar or rod to pass fully through the eyelet and be set in a fixed-in position.

Typically, the locking mechanism is found just beyond the body and/or curve of the fastener. The curve may or may not have a notch at the juncture of the two. The change in dimension serves to help create a condition whereby the locking mechanism is held in place. This occurs because the ends of the body at the curve are narrow enough to pass through the eyelet and allow the backside of the locking mechanism to hold the fastener in place once expanded. The curve on the body of the fastener can take on a number of configurations including but not limited to, attaching to the locking mechanism directly or in a slightly varied way by curving or stepping at a right angle down to the locking mechanism. This variation may also assist the locking mechanism to hold the fastener in a secondary manner. Not only is the backside of the fastener larger than the eyelet and held horizontally in place, but in the condition described above, is also vertically held in position by placing the locking mechanism below the fastener. This secondary manner of locking also utilizes the top plane of the mechanism as well as its backside to hold and lock the fastener in place.

The locking mechanism may also be composed of a variety of materials that facilitate its function or add to its durability. The fastener may be composed of homogeneous material or composed in part of materials that are not elastic in order to allow the fastener to be more rigid, more durable, or more easily grabbed in particular locations. The fastener end may be altered such that the terminus of the triangular end could be composed of plastic, metal or any other variety of materials that facilitate gripping. The end may also be configured such that the terminus is a variety of shapes such as a sphere or elliptical object that appears to be integrated into the fastener. The object may be narrow enough to pass through the eyelet of a shoe but wide enough to be grabbed and pulled. The locking mechanism may include a series of conjoined shapes such as a sphere or elliptical shape in addition to a triangle or 'wing' shape that are combined to facilitate gripping and locking. The end may also have a hook, hole, slot, or other varying shapes that enables the fastener to lock onto a specific geometry included on the footwear, including but not limited to a D-ring, notch, hook, or the like.

The transitions of form and shape that occur along the fastener length or the body itself may be particularly prone to damage and tear because of the forces that are intrinsic to this type of object. It is for this reason that a material other than an elastomer, such as metal, plastic, or composite may be added to areas such as the outside edges of the notches in the fastener or triangular locking mechanism of the fastener. This may maintain elasticity at the body as well as protect critical areas along the length of the fastener.

The locking mechanism may also be altered such that it is molded to accommodate other materials including, but not limited to, plastic, metal, and composite materials that simply slide in place on the fastener and are fixed. In another embodiment, the alternate material may be co-molded with the locking mechanism to form a unified object.

Various embodiments include an elastomeric fastener capable of being customized to display an image or script on the surface of the fastener. The image or script may be placed on the fastener as an item or items on one individual fastener, or an item or items across the face of an individual fastener that in turn creates a larger image by the placing of all fasteners together as a whole on the face of an article such as a shoe. The customization may include an indentation or printing on a surface of the elastomeric fastener, a relief on the surface, projections above the surface, an opening entirely through the elastomeric fastener, or printing and/or indentations on both sides of the elastomeric fastener. The elastomeric fastener may be composed of material having multiple colors either on one side of the fastener or on different sides of the fastener. The elastomeric fastener may include a buckle, latch, or any variety of securing mechanism on the main body of the elastomeric fastener. The buckle, latch, or any variety of securing mechanism may be functional or decorative.

In some embodiments, an image or script appearing on the elastomeric fastener is determined by the manufacturer before retail sales of the elastomeric fastener, or customized by the prospective buyer during retail sales, and is limited only by the size of an individual fastener or group of fasteners.

The fastener is optionally made from a material that is molded or stamped. A script or image may be added to the fastener surface by adding the mirror image of that script or image to the form of the mold or stamp. The script or image may be molded into the fastener at any depth including through the fastener material.

Various dyes or inks and using adhering processes including but not limited to silk screening or sublimation printing may be used to print directly on the surface of the elastomeric fastener. Printing on the fastener may occur on any surface of the fastener, comprising sides, top, bottom, ends, stamped/molded areas and the interior of the fastener. Dyes or inks may be injected into the fastener to fill voids on the interior of the fastener created through the molding and/or stamping process. In some embodiments, the elastomeric fastener includes a writable and/or rewritable surface on which a user can write text or images.

The elastomeric fastener is optionally molded from a material that is made in a variety of colors. These colors may be mixed to create an unlimited variety of custom and/or random color patterns that appear as such on the elastomeric fastener or sets thereof. The elastomeric fastener may also be molded in such a way as to create the appearance that its top is one color and its bottom is a different color or that one side is one color and the other side is a different color. In addition, alternate visual elements may be molded into the elastomeric fastener including but not limited to metallic flakes and opal essence. The transparency of the elastomeric fastener can vary from completely opaque to transparent. In addition, the elastomeric fastener may have a variety of transitions between transparent sections and opaque sections. These transitions may be random or predetermined for a desirable visual effect.

The elastomeric fastener is optionally constructed such that it appears to be attached to itself by some type of latch, buckle, snap, hook and eye, clip, or various other fastening devices. The elastomeric fastener in this case is optionally purely decorative and added for aesthetic purposes.

The elastomeric fastener may also be constructed such that the fastening devices are functional instead of decorative. For example, the elastomeric fastener may be constructed in two parts, each part being set into the eyelet of the shoe at the triangular ends. A fastening device such as a latch, buckle, snap, hook and eye, clip, Velcro™ attachment, or various other fastening devices may be located on the opposing ends that meet over the tongue of the shoe. The operation of the fastening device is optionally similar to that of a buckle of a belt or the snap of a jacket. The fastening device may be synched, buckled, snapped or fastened by any other means such that the tension of the fastener may be altered through the manipulation of the device where the two ends come together.

Various embodiments of the invention include a method of inserting an elastomeric fastener into existing shoe eyelets, where the elastomeric fastener is stretched as it is inserted into one or more eyelets. Either the body of the elastomeric fastener, or the locking mechanisms on the elastomeric fastener, or the notches if present, and/or any variation therein may be stretched as the elastomeric fastener is inserted into one or more eyelets. The elastomeric fastener remains in a stretched position when locked into the eyelets. The elastomeric fastener may be inserted into the eyelets by hand or by machine.

In some embodiments, the elastomeric fastener is attached to a shoe when the shoe is on a foot, but is preferably and more readily attached or partially attached to the shoe when the shoe is off the foot. In one method, the elastomeric fastener may be held in one hand toward the base of the body exposing the fastening mechanism on one side of the fastener. The shoe eyelet that is to be pierced by the fastening mechanism is turned inward slightly and made visible to the user's eye. The end of the elastomeric fastener is gripped toward the end of the fastening mechanism and pushed down and into the eyelet. Additionally, for other methods, or for alternate fastening mechanism embodiments, the end of the fastener is placed through by squeezing the ends together and piercing the eyelet, or for other fastening mechanism embodiments, the fastening mechanism rod or alternate shape is pushed into the eyelet.

Once the locking mechanism has been placed into the eyelet, the locking mechanism can be pushed and/or pulled through. Resistance created by wider or greater amounts of material toward the back of the locking mechanism may be a part of this process. Once the locking mechanism has been passed fully through one eyelet and resistance has subsided, the fastener will lock into place by expansion at the wider portion of the locking mechanism. This may be due in part to the larger volume of material at the backside of the locking mechanism or the configuration of such in alternate embodiments. This also may be due to the change in dimension in the body of the fastener that is optionally smaller than the locking mechanism at the end of the elastomeric fastener.

Once the elastomeric fastening is secured at one end, it may be placed through another eyelet at another location. For other elastomeric fastener embodiments, the fastening mechanism may already be permanently fastened at one location depending upon the design of the shoe and may only need to be fastened at the opposing side or alternate locations. The fastening mechanism is optionally also be configured for alternate elastomeric fastener embodiments such that a second location may not be the only location but one of a plurality of locations to be locked before the elastomeric fastener is completely secure.

Once attached at least one point, the elastomeric fastener may be stretched and pulled across the face of the shoe. The amount of stretch in the elastomeric fastener may be dependent on to the type of material, cross sectional thickness, durometer, or length of the body of the fastener. Once the elastomeric fastener has been secured and stretched, the elastomeric fastener may be held in one hand as another eyelet is turned down and made visible to the eye by the opposite hand. The fastener may be held as described herein, including alternate embodiments of elastomeric fastener, and pushed into the eyelet. Once the locking mechanism has been placed into the eyelet, it may be pushed and/or pulled through as also described herein.

In one embodiment, the placement of the fastener is such that the triangular end (or any other end shape configuration that allows locking and passing through the eyelet) is disposed below the surface of the shoe and the body of the elastomeric fastener remains above the surface of the shoe. In another embodiment, the end is disposed above the surface of the shoe and part of the body of the elastomeric fastener is disposed below the surface as it passes across the top of the shoe or below the tongue of the shoe.

In various embodiments, providing the body of the fastener is a proper dimension for the eyelet separation across the shoe, the resulting effect of the elastomeric fastener is that it is stretched across the front of the shoe. Each fastener may be added to the eyelets of the shoe in a similar manner.

FIGS. 1A-1C illustrate an Elastomeric Fastener, generally designated 100, according to various embodiments of the invention. FIG. 1A illustrates a plan view, FIG. 1B illustrates a side view, and FIG. 1C illustrates a front view. The illustrated embodiment is embossed with Text 120. The Body 110 of the Elastomeric Fastener 100 includes two Curved Portions 130 configured such that the Curved Portions 130 contact each of the triangular shaped Locking Mechanisms (couplers) 140 at an angle of approximately 90 degrees. In various embodiments the angle between the body 110 and 210 the locking mechanisms 140 is greater than 0, 10, 20 35, 45, 90 or 110 degrees.

FIGS. 2A-2R illustrate plan view of various alternative configurations of the Elastomeric Fastener 100, according to various embodiments of the invention. These configurations include alternative configurations of Locking Mechanisms 140. Specifically, FIG. 2A illustrates an embodiment of Locking Mechanisms 140 including a triangular end. FIG. 2B illustrates an embodiment of Locking Mechanisms 140 including a rectangular end. FIG. 2C illustrates an embodiment of Locking Mechanisms 140 including an alternative triangular end. FIG. 2D illustrates an embodiment of Locking Mechanisms 140 including a circular end. FIG. 2E illustrates an embodiment of Locking Mechanisms 140 including an oval end. FIG. 2F illustrates an embodiment of Locking Mechanisms 140 including an end having multiple notches with a triangular outline. FIG. 2F illustrates an embodiment of Locking Mechanisms 140 including a combination of multiple shapes. FIG. 2G illustrates an embodiment of Locking Mechanisms 140 including a combination of multiple shapes one or more of them being three dimensional. FIG. 2H illustrates an embodiment of Locking Mechanisms 140 including an end comprised of more than one material. These more than one materials are optionally co-molded and may include materials having different durometers. This embodiment also optionally includes co-molding of a variety of materials for different effect in locations other than the locking mechanism such as the curving transitional portion and/or body.

FIG. 2I illustrates an embodiment of Locking Mechanisms 140 including a Velcro Section 210. In alternative embodiment, the Velcro Section 210 may be replaced by a magnet, suction cup, adhesive, or the like.

FIG. 2J illustrates an embodiment of Locking Mechanisms 140 including a Slot 220 configured to receive a hook. FIG. 2K illustrates an embodiment of Locking Mechanisms 140 including a three dimensional spherical end. FIG. 2L illustrates an embodiment of Locking Mechanisms 140 including a Hook 230. FIG. 2M illustrates an embodiment of Locking Mechanisms 140 including a diamond shape. FIG. 2N illustrates an embodiment of Locking Mechanisms 140 including a five sided end. Alternative embodiments may include a six, or more, sided end. FIG. 2O illustrates an embodiment of Locking Mechanisms 140 including an end that protrudes at approximately 90 degrees from Body 110. FIG. 2P illustrates an embodiment of Locking Mechanisms 140 including a short rectangular end. FIG. 2Q illustrates an embodiment of Locking Mechanisms 140 including a Cross-Bar 240. Cross-Bar 240 may be flexible or stiff. In embodiments wherein Cross-Bar 240 is stiff, it is inserted one end at a time.

FIG. 2R illustrates an embodiment of Locking Mechanisms 140 including an opening 250. Opening 250 may be included in any of the other embodiments disclosed herein. In some embodiments two or more different styles or combination of styles of Locking Mechanisms 140 are used in the same Elastomeric Fastener 100.

Figure 3:
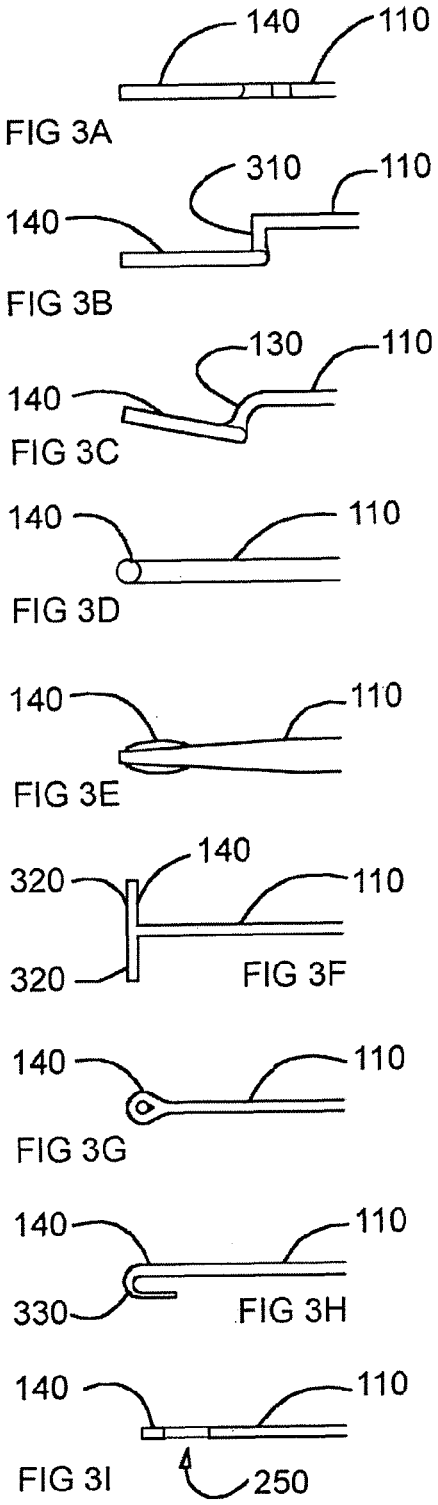
FIGS. 3A-3I illustrate side views of various alternative configurations of the elastomeric fastener, according to various embodiments of the invention.

FIGS. 3A-3I illustrate side views of various alternative configurations of the elastomeric fastener, according to various embodiments of the invention. The shapes illustrated in these side views can be included in most of the embodiments illustrated in FIGS. 2A-2R. Specifically, FIG. 3A illustrates an embodiment in which Body 110 and Locking Mechanism 140 are co-planer. FIG. 3B illustrates an embodiment in which Body 110 and Locking Mechanism 140 are separated by a right angle Step 310. FIG. 3C illustrates an embodiment in which Body 110 and Locking Mechanism 140 are separated by the Curved Portion 130 as illustrated in FIG. 1B. FIG. 3D illustrates an embodiment in which Locking Mechanism 140 includes a circular co-planar section. FIG. 3E illustrates an embodiment in which Body 110 and Locking Mechanism 140 include a combination of two shapes such as illustrated in top view 2G.

FIG. 3F illustrates an embodiment in which Locking Mechanism 140 include one or two Protrusions 320 rising from Body 110 at an angle of approximately 90 degrees. In various embodiments, Protrusions 320 are at angles of greater than 45, 90 or 120 degrees relative to a plane of Body 110.

FIG. 3G illustrates an embodiment in which Body 110 and Locking Mechanism 140 are co-molded parts including a cross-bar that is flexable or stiff as shown in top view 2Q. FIG. 3H illustrates an embodiment in which Locking Mechanism 140 includes a Hook 330. Hook 330 optionally includes a co-molded elastomer or solid material attached to an elastomer. For example, Hook 330 may include a ridged plastic configured to hook onto an eyelet of a shoe. FIG. 3I illustrates an embodiment in which Locking Mechanism 140 includes an Opening 250.

FIGS. 4A-4I illustrate various sectional views of various alternative configurations of the elastomeric fastener, according to various embodiments of the invention. These sectional views are perpendicular to both the plan views of FIGS. 2A-2R and the side views of FIGS. 3A-3I. In various embodiments, the cross section of Elastomeric Fastener varies with position. As such, the Locking Mechanism 140 may include different cross-sections than the Body 110. The cross-sections illustrated in FIGS. 4A-4I may be included in most of the embodiments illustrated in FIGS. 2A-2R and 3A-3I.

Figure 4:
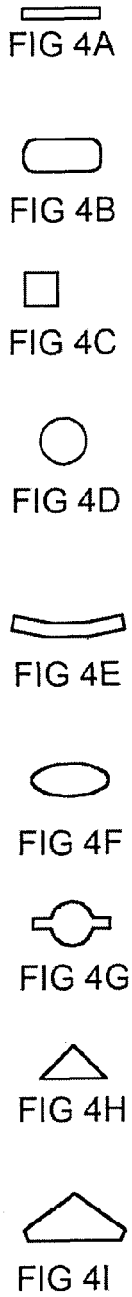
FIGS. 4A-4I illustrate various sectional views of various alternative configurations of the elastomeric fastener, according to various embodiments of the invention.

Specifically, FIG. 4A illustrates a rectangular cross-section. FIG. 4B illustrates a rectangular cross-section including rounded edges. FIG. 4C illustrates an approximately square cross-section. FIG. 4D illustrates a round cross-section. FIG. 4E illustrates a curved cross-section. FIG. 4F illustrates an oval cross-section. FIG. 4G illustrates a cross-section including a central lobe. FIG. 4H illustrates a triangular cross-section. FIG. 4I illustrates multi-sided cross-section. The embodiments illustrated by FIG. 4I may included a variety of sides and/or additional cross sectional shapes.

FIGS. 5A-5H illustrate various sectional side elevation views of various alternative configurations of the Body 110 of Elastomeric Fastener 100, according to various embodiments of the invention. These embodiments of Body 110 may be combined with most of the embodiments illustrated in FIG. 2A-2R, 3A-3I or 4A-4I.

Figure 5:
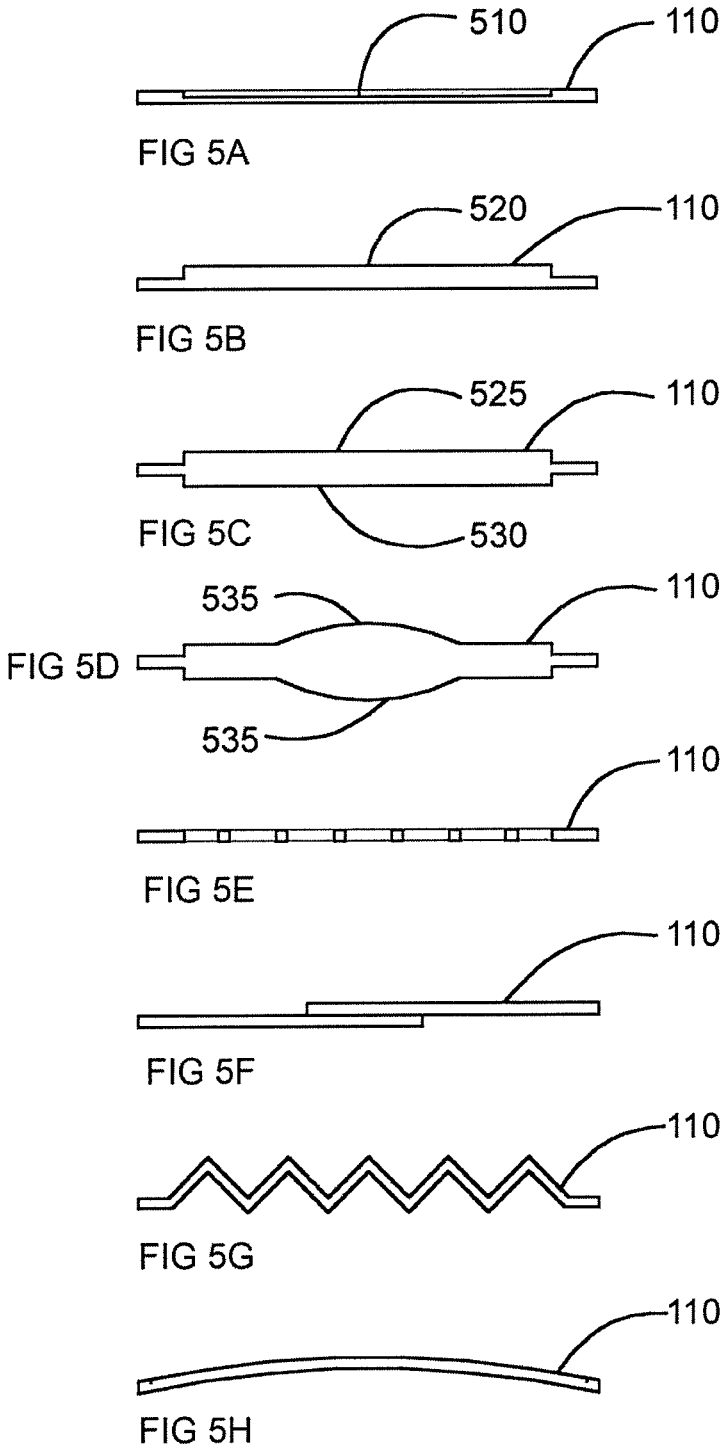
FIGS. 5A-5H illustrate various sectional side views of various alternative configurations of the elastomeric fastener, according to various embodiments of the invention.

Specifically, FIG. 5A illustrates an embodiment of Body 110 including an Embossed Surface 510. FIG. 5B illustrates an embodiment of Body 110 including a raised surface 520. FIG. 5C illustrates an embodiment of Body 110 including both Raised 525 and Lowered 530 surfaces. FIG. 5D illustrates an embodiment of Body 110 including a one or more convex (or concave) Surfaces 535. FIG. 5E illustrates an embodiment of Body 110 including one or more holes in the surface. FIG. 5F illustrates an embodiment of Body 110 including overlapping surfaces optionally including multiple parts. FIG. 5G illustrates an embodiment of Body 110 including a variable surface. FIG. 5H illustrates an embodiment of Body 110 including a curved surface.

Figure 6:
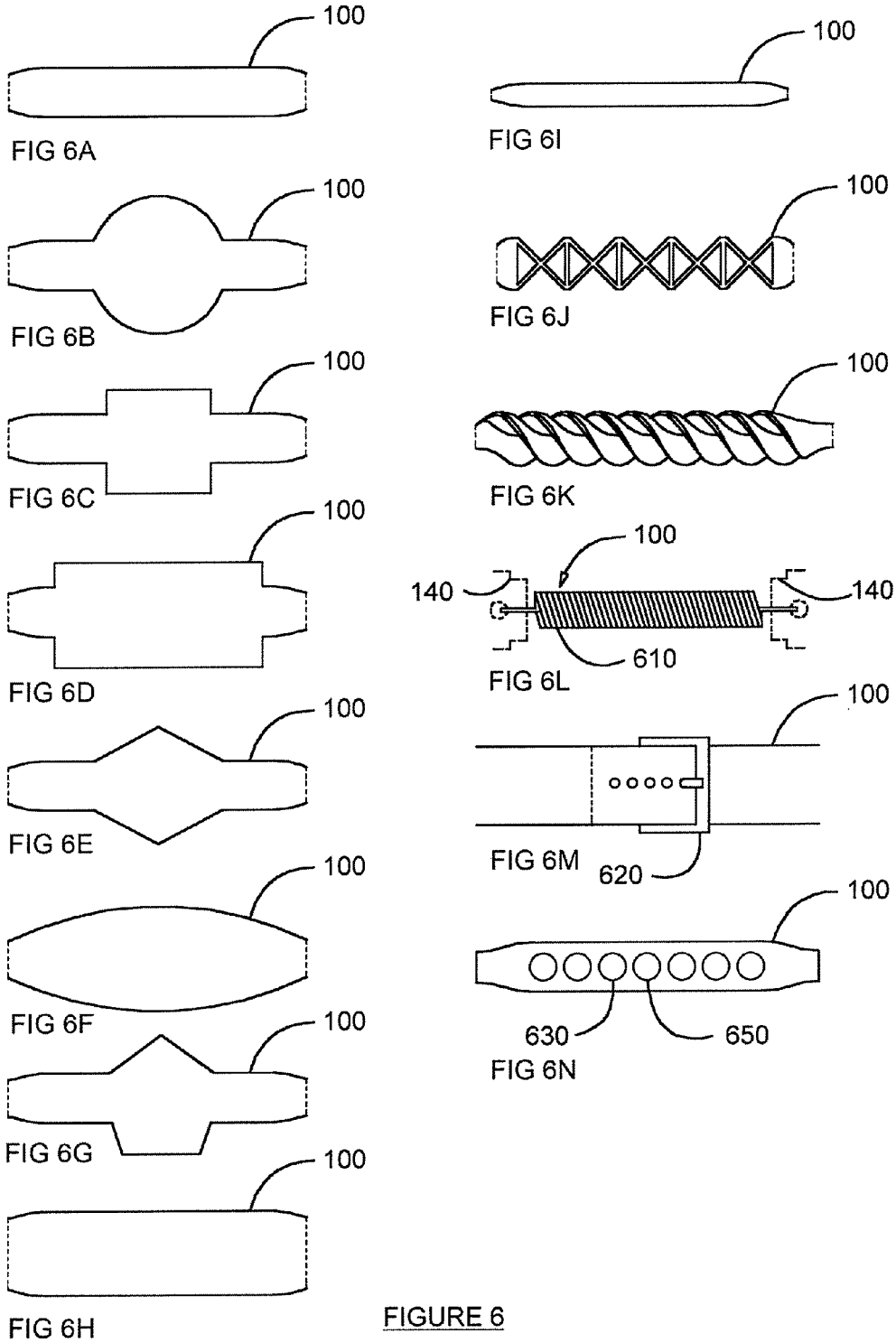
FIGS. 6A-6N illustrate various plan views of the elastomeric fastener, according to various embodiments of the invention.

FIGS. 6A-6N illustrate various plan views of the Body 110 of Elastomeric Fastener 100, according to various embodiments of the invention. These embodiments may be combined with embodiments illustrated by most of the other figures discussed herein.

Specifically, FIG. 6A illustrates an embodiment of Body 110 including essentially straight co-planar sides. These sides are typically between 3 and 7 millimeters apart. FIG. 6B illustrates an embodiment of Body 110 including one or more rounded edges. FIG. 6C illustrates an embodiment of Body 110 including one or more square edges. FIG. 6D illustrates an embodiment of Body 110 including rectangular edges. FIG. 6E illustrates an embodiment of Body 110 including triangular and/or diamonds shaped edges. FIG. 6F illustrates an embodiment of Body 110 including bowed or curved edges. FIG. 6G illustrates embodiments of Body 110 including edges of two different shapes. These different shapes can include any of the shape illustrated elsewhere herein.

FIGS. 6H and 6I illustrate embodiments of Body 100 including essentially straight co-planar sides. With respect to FIG. 6H, in various embodiments, these sides are equal to or less than 5, 4, 3, 2 or 1 millimeters apart. With respect to FIG. 6I, in various embodiments, these sides are equal to or greater than 5, 6, 7, 8, 9 or 10 millimeters apart. Other shapes illustrated herein may include similar distances between sides.

FIG. 6J illustrates an embodiment of Body 110 including a structural and/or decorative shape, optionally including openings. FIG. 6K illustrates an embodiment of Body 110 including a three dimensional structure, e.g., a spiral shape. FIG. 6L illustrates an embodiment of Body 110 including a Spring 610. Spring 610 may comprise metal, plastic, or an elastomeric material.

FIG. 6M illustrates an embodiment of Body 110 including a Buckle 620. Buckle may be functional or non-functional. In alternative embodiments, Buckle 620 is replaced by a latch, snap, or the like.

FIG. 6N illustrates various embodiments of Body 110 including one or more Lights 630. Lights 630 may be disposed in a variety of patterns and be supported by electronics and/or a power source, such as a battery. In one embodiment, lights are powered by a kinetic power source that derives power from movement or use of a shoe. As such, the light may be activated by walking.

Figures 7, 7A, 7B, 7C, 7D, 7E:
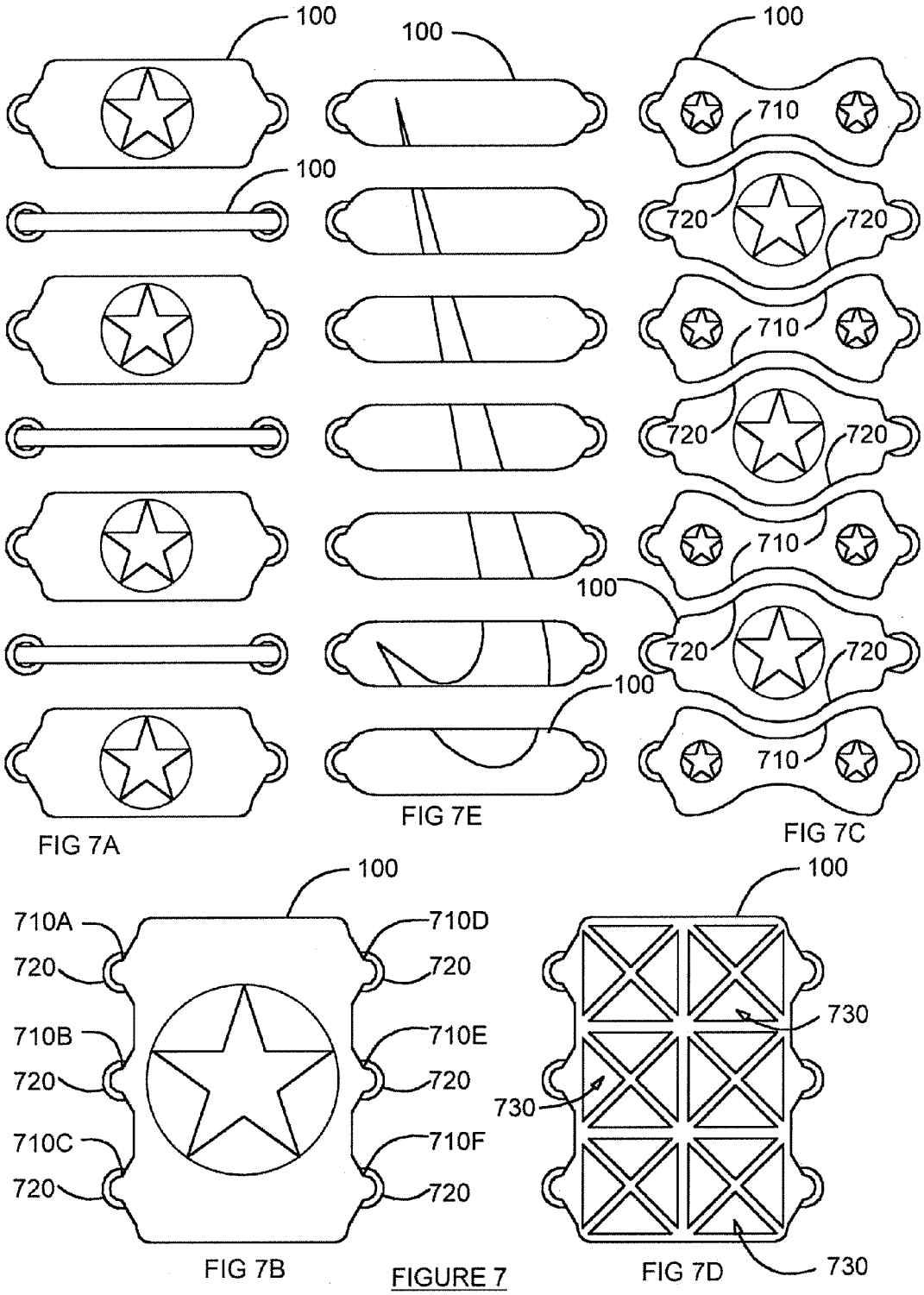
FIGS. 7A-7E illustrate various combinations of the elastomeric fastener as used to fasten a shoe, according to various embodiments of the invention.

FIGS. 7A-7E illustrate various combinations of Elastomeric Fastener 100 as used to fasten a shoe, according to various embodiments of the invention. For example, FIGS. 7A and 7C illustrate the use of two different types of Elastomeric Fastener 100 at the same time. In FIG. 7A, thinner and thicker embodiments are used. In FIG. 7C, the two different embodiments of Elastomeric Fastener 100 include edges 710 and 720 that conform to each other. Each of there combinations of Elastomeric Fastener 100 are optionally used in a set of eyelets of a shoe.

FIGS. 7B and 7D illustrate various embodiments in which Elastomeric Fastener 100 is configured to attach at more than two connection points, e.g., more than two eyelets. These embodiments of Elastomeric Fastener 100 each include more than two Locking Mechanism 140. For example, FIG. 7B illustrates an embodiment that includes six instances of Locking Mechanism 140, designated 710A-710F, inserted in six Eyelets 720. The embodiments illustrated by FIGS. 7B and 7D differ in that FIG. 7B includes an image displayed on Elastomeric Fastener 100 and FIG. 7D includes a decorative pattern having Holes 730.

FIG. 7E illustrates embodiments wherein several Elastomeric Fastener 100 are used in combination to form an image (e.g., text, a logo, a picture, a symbol, and/or the like). In FIG. 7E the Nike Swoosh™ is shown. However, other images may be formed using several Elastomeric Fastener 100.

FIGS. 8A-8D illustrate various further embodiments of Elastomeric Fastener 100 configured to attached to more than one Eyelet 720 of a shoe. These embodiments include various decorative patterns and various numbers of Locking Mechanism 140. FIG. 8A illustrates an embodiment of Elastomeric Fastener 100 including six Locking Mechanisms 140 and a crossing pattern. FIG. 8B illustrates an embodiment of Elastomeric Fastener 100 including four Locking Mechanisms 140 and a crossing pattern. Further embodiments of Elastomeric Fastener 100 may include 5, 7, 8, 9 10 or more instance of Locking Mechanism 140. FIGS. 8C and 8D illustrate embodiments of Elastomeric Fastener 100 including four instances of Locking Mechanisms 140 and a cross or "T" pattern. The embodiments illustrated by FIG. 8D optionally include a circular cross-section.

Figure 9:
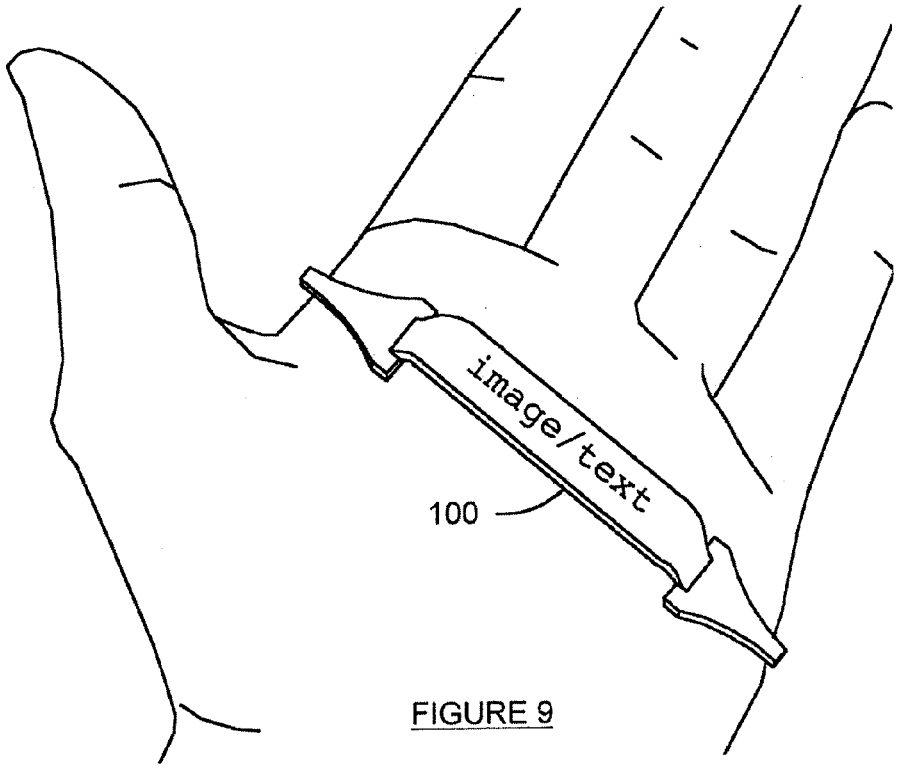
FIG. 9 illustrates an elastomeric fastener including bent couplings, according to various embodiments of the invention.

FIG. 9 illustrates Elastomeric Fastener 100 including bent couplings (Locking Mechanisms at an angle relative to Body 110), according to various embodiments of the invention. These embodiments may be used for footwear as well as other applications.

Figure 10:
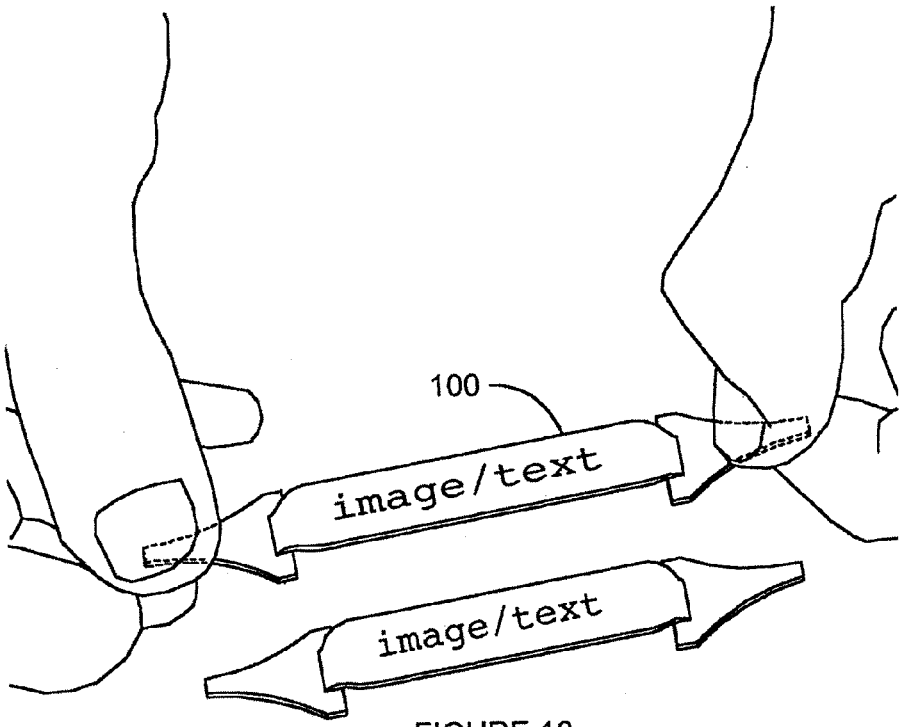
FIG. 10 illustrates deformation of an elastomeric fastener, according to various embodiments of the invention.

FIG. 10 illustrates deformation (stretching) of Elastomeric Fastener 100, according to various embodiments of the invention. The deformation is accomplished by pulling with fingers.

Figure 11:
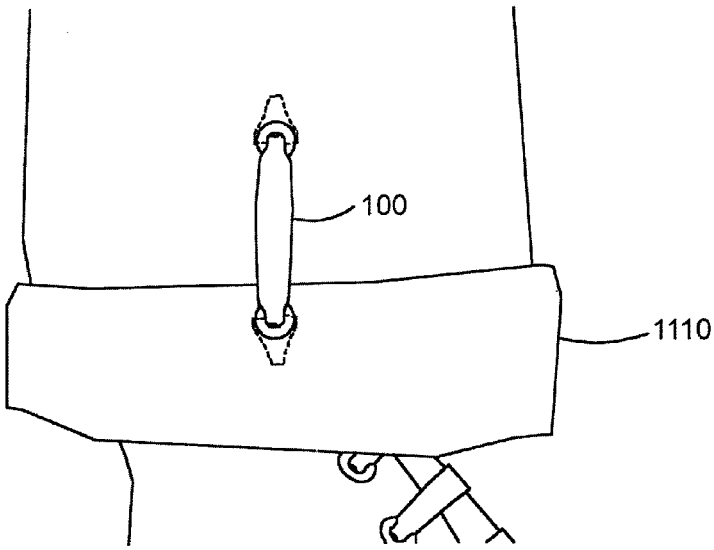
FIG. 11 illustrates use of an elastomeric fastener in a pant cuff, according to various embodiments of the invention.

FIG. 11 illustrates use of Elastomeric Fastener 100 to support a Pant Cuff 1110, according to various embodiments of the invention. In addition, it can be used to hold back rolled cuffs on a shirt, a jacket, a collar, a hood, or any fabric instance where rolling and securing are desired.

Figure 12:
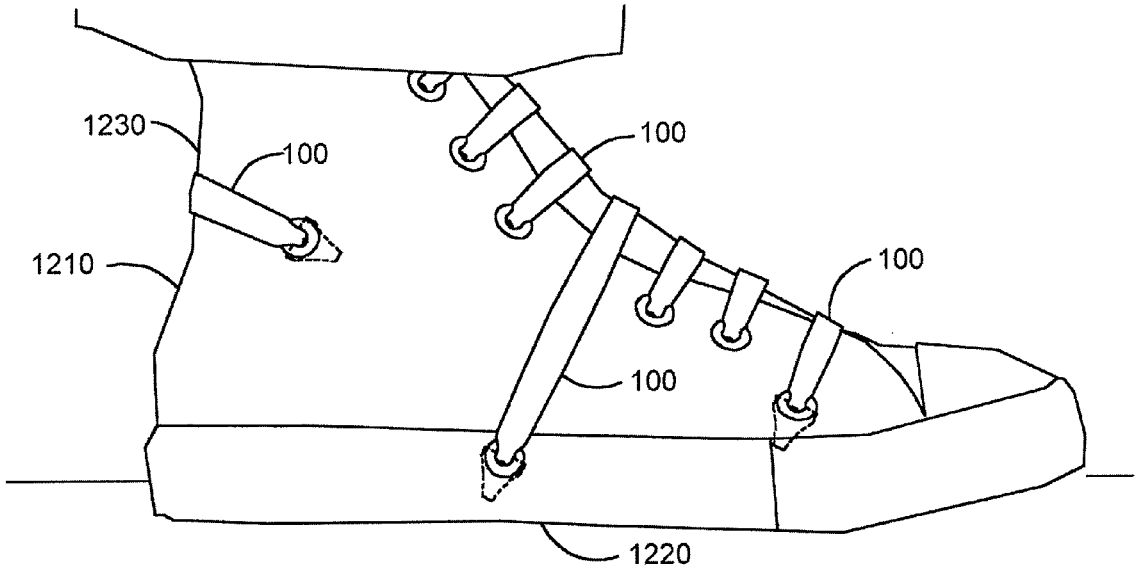
FIG. 12 illustrates use of an elastomeric fastener in a shoe, according to various embodiments of the invention.

FIG. 12 illustrates use of several Elastomeric Fastener 100 in a Shoe 1210, according to various embodiments of the invention. In these embodiments, Elastomeric Fasteners 100 of various lengths are used to secure the same shoe. Some of the Elastomeric Fasteners 100 extent to a Sole 1220 of Shoe. Some of the Elastomeric Fasteners 100 are configured to rap around a Heel 1230 of Shoe. Some embodiments of the invention include a shoe including eyelets as illustrated in by Shoe 1210. These elastomeric fasteners may be used to secure different portions of the shoe together. For example, in FIG. 12, the sole of the shoe may be attached by the locking of the elastomeric band to the upper portion of the shoe. Other portions including, but not limited to, the heel cup, tongue, toe cap may also be secured by an elastomeric fastener. The use of elastomeric fasteners may replace the need for glue or stitching in some areas of the shoe, and may allow for addition customization by means of swapping out portions of the shoe and re-fastening new portions using elastomeric fasteners.

FIGS. 13A-13C illustrates use of Elastomeric Fastener 100 in a Sandal 1310, according to various embodiments of the invention. In some embodiments, Elastomeric Fastener 100 is configured to secure Sandal 1310 over the top of a foot as illustrated in FIG. 13A. Each Elastomeric Fastener 100 may be temporally attached to Sandal 1310 at two points as illustrated in FIG. 13A or permanently attached on one side and temporally attached on the other side as illustrated in 13B. In some embodiments, Elastomeric Fastener 100 is configured to secure Sandal 1310 around the heel and/or over the top of afoot as illustrated in FIG. 13C.

Figure 14:
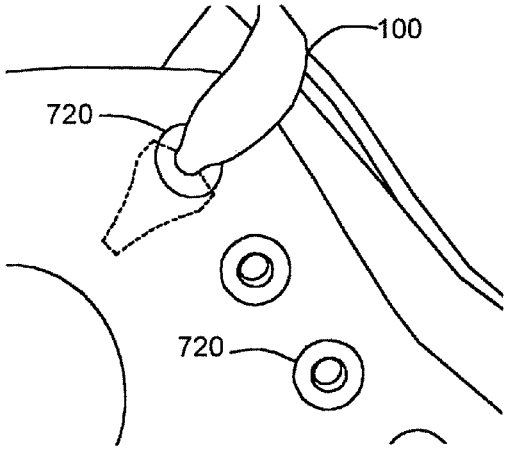
FIG. 14 illustrates an elastomeric fastener configured for use in an eyelet located on a side of a shoe, according to various embodiments of the invention.

FIG. 14 illustrates embodiments of Elastomeric Fastener 100 configured for use in a reinforced embodiment of Eyelet 720 located on a side of a shoe.

Figure 15:
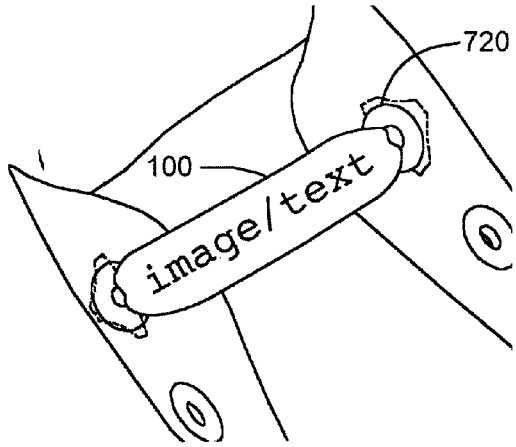
FIG. 15 illustrates an elastomeric fastener configured for use in an eyelet located near a top of a shoe, according to various embodiments of the invention.
Figure 16:
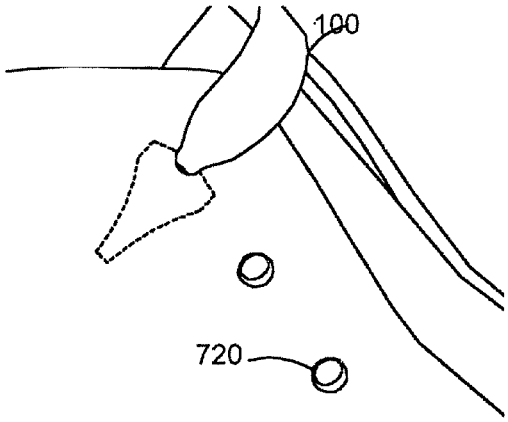
FIG. 16 illustrates an elastomeric fastener configured for use with a leather eyelet, according to various embodiments of the invention.

FIG. 15 illustrates embodiments of Elastomeric Fastener 100 configured for use in an Eyelet 720 located near a top of a shoe, according to various embodiments of the invention. FIG. 16 illustrates embodiments of Elastomeric Fastener 100 configured for use with a leather (non-reinforced) embodiment Eyelet 720. A stiffness of Locking Mechanism 140 may be different in embodiments of Elastomeric Fastener 100 configures for reinforce and non-reinforced Eyelets 720.

Figure 17:
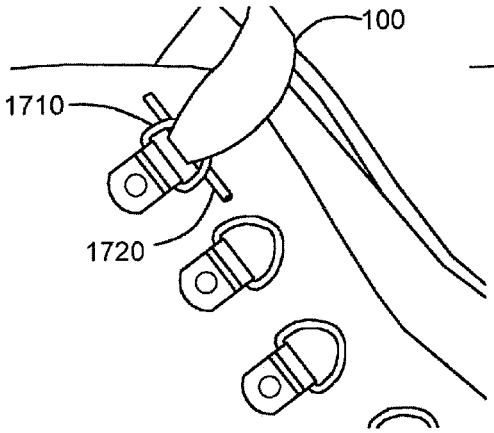
FIG. 17 illustrates an elastomeric fastener configured for use with D-rings, according to various embodiments of the invention.

FIG. 17 illustrates embodiments of Elastomeric Fastener 100 configured for use with D-rings 1710. These embodiments optionally include a stiff Bar 1720 within Locking Mechanism 140.

Figure 18:
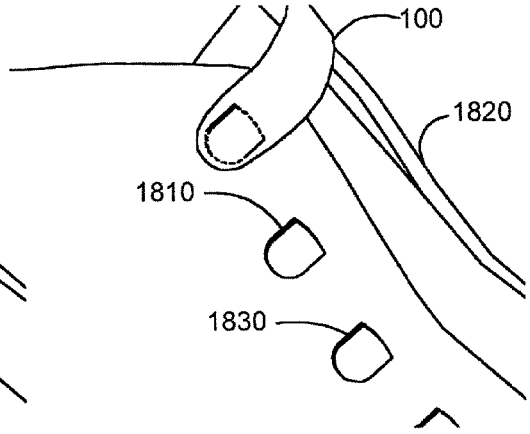
FIG. 18 illustrates an elastomeric fastener configured for use with Velcro™ tabs, magnets, suction cups, or the like, according to various embodiments of the invention.

FIG. 18 illustrates embodiments of Elastomeric Fastener 100 configured for use with Velcro™ tabs, magnets, suction cups, hooks, or the like, according to various embodiments of the invention. For example, in some embodiments, Elastomeric Fastener 100 includes Velcro™ configured to attach to a Velcro™ Pad 1810 included in a Shoe 1820. In some embodiments, Elastomeric Fastener 100 includes a magnet configured to attach to a magnetic Pad 1810 included in Shoe 1820. In some embodiments, Elastomeric Fastener 100 includes a hook configured to hook into an opening 1830 within Shoe 1820. In some embodiments, Elastomeric Fastener 100 uses adhesion for securing 1830 within Shoe 1820.

Figure 19:
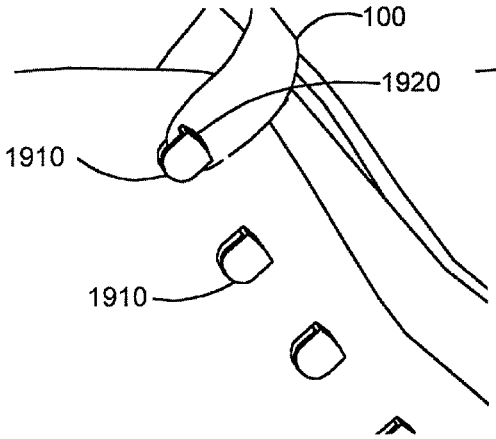
FIG. 19 illustrates an elastomeric fastener configured for use with boots, according to various embodiments of the invention.

FIG. 19 illustrates embodiments of Elastomeric Fastener 100 including a Slot 1920 configured to attach to a Hook 1910 included in footwear, such as a boot.

Figure 20:
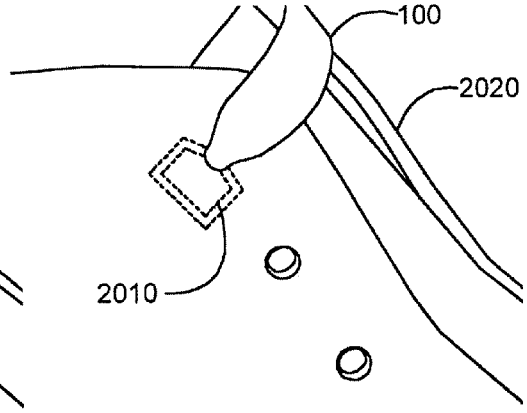
FIG. 20 illustrates elastomeric fasteners sewn into one or both sides of shoe, according to various embodiments of the invention.

FIG. 20 illustrates embodiments of Elastomeric Fastener 100 in which one end of Elastomeric Fastener 100 is sewn into a Shoe 2020 using Stitches 2010. In some embodiments, both ends of Elastomeric Fastener 100 are sewn into Shoe 2020. As such, Elastomeric Fastener 100 is permanently attached in at least two places to Shoe 2020. In some embodiments, Elastomeric Fastener 100 is attached in only one place to Shoe 2020. In some embodiments, Elastomeric Fastener 100 is permanently attached in at least two places to Shoe 2020 but configured to be non-permanently attached (e.g., using Locking Mechanism 140) in one or more other places to Shoe 2020.

Figure 21:
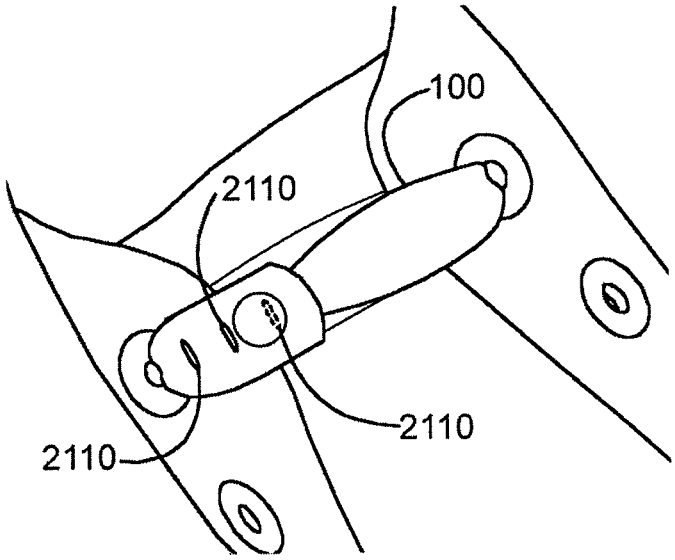
FIG. 21 illustrates an elastomeric fastener configured to lock into itself to secure a shoe, according to various embodiments of the invention.

FIG. 21 illustrates embodiments of Elastomeric Fastener 100 configured to lock into itself to secure a shoe. In these embodiments, Elastomeric Fastener 100 typically includes both male and female ends (e.g., Slots 2110) of Locking Mechanism 140. Some embodiments include more than one female ends configured to allow adjustment of tension.

Figure 22:
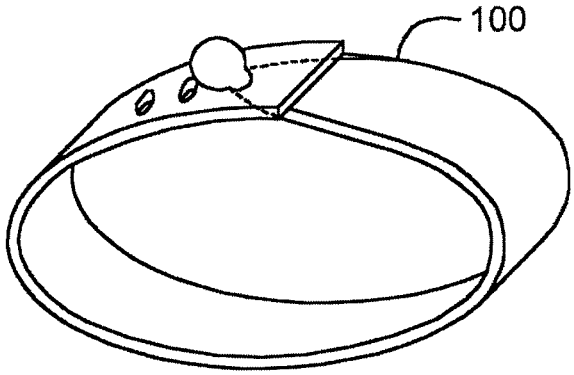
FIG. 22 illustrates an elastomeric fastener configured to lock into itself, according to various embodiments of the invention.

FIG. 22 illustrates various embodiments of Elastomeric Fastener 100 configured to lock into itself. These embodiments may be used for applications other than footwear.

Figure 23:
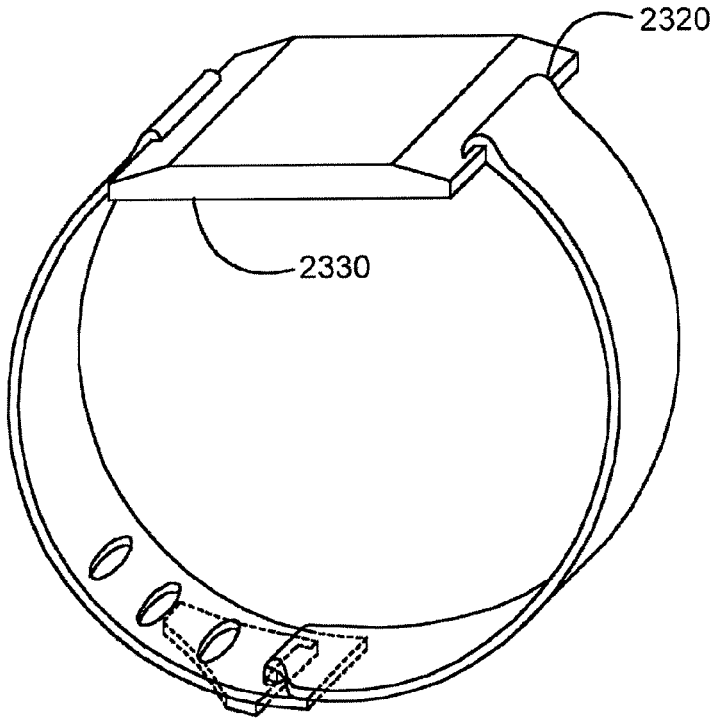
FIG. 23 illustrates an elastomeric fastener configured for use as a watchband, according to various embodiments of the invention.
Figure 24:
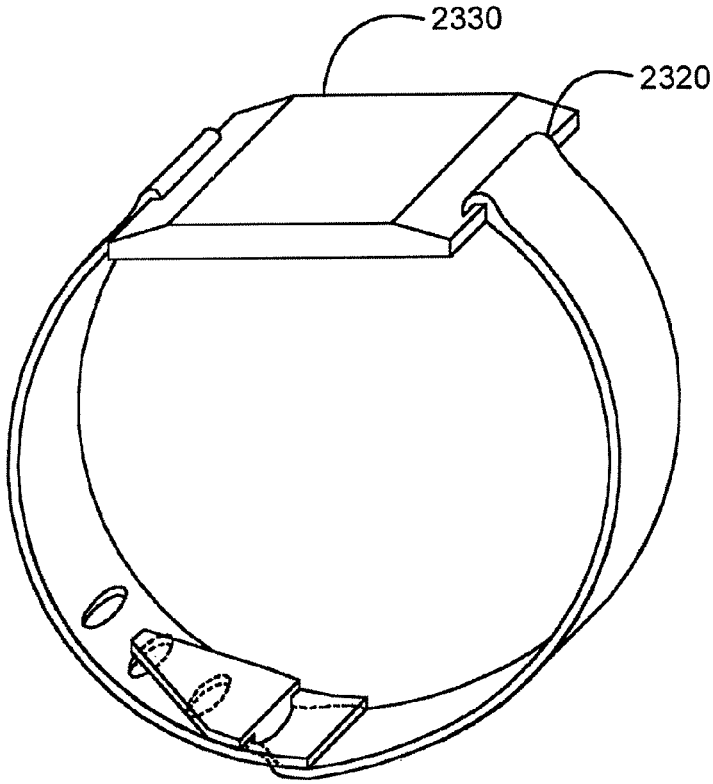
FIG. 24 illustrates an elastomeric fastener configured for use as a watchband and including an alternative locking direction, according to various embodiments of the invention.

FIG. 23 illustrates various embodiments of Elastomeric Fastener 100 configured for use as a watchband 2310. These embodiments optionally include a Loop 2320 configured to attach to a Watch 2330. FIG. 24 illustrates various embodiments of Elastomeric Fastener 100 in which the tip of Locking Mechanism 140 is disposed between the Elastomeric. Fastener 100 and a user's wrist when fastened.

Figure 25:
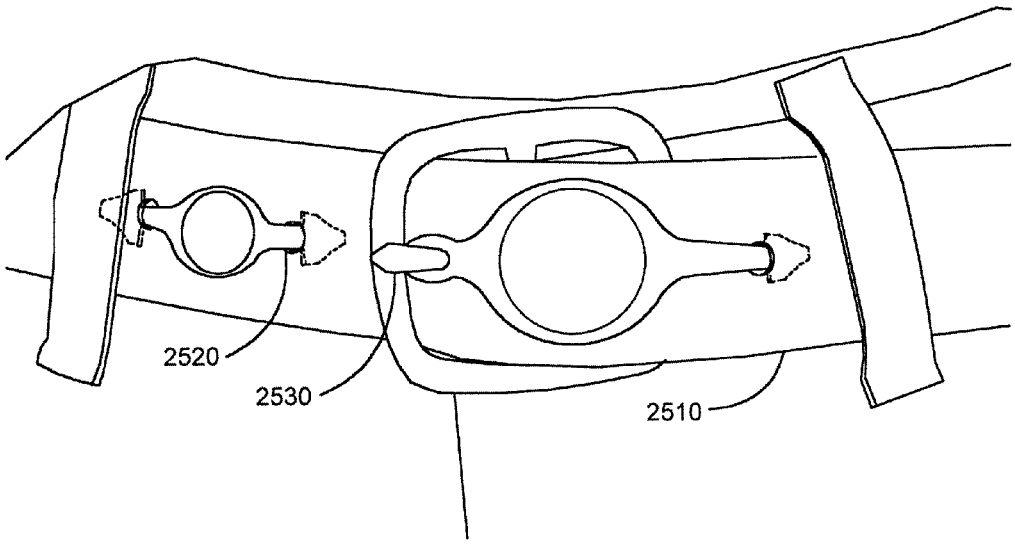
FIG. 25 illustrates an elastomeric fastener configured for use with a belt, according to various embodiments of the invention.

FIG. 25 illustrates various embodiments of Elastomeric Fastener 100 configured for use with a belt 2510. In some embodiments, Elastomeric Fastener 100, designated 2520, is configured to tightening Belt 2510. In some embodiments, Elastomeric Fastener 100 is configured as part of a Buckle 2530.

Figure 26:
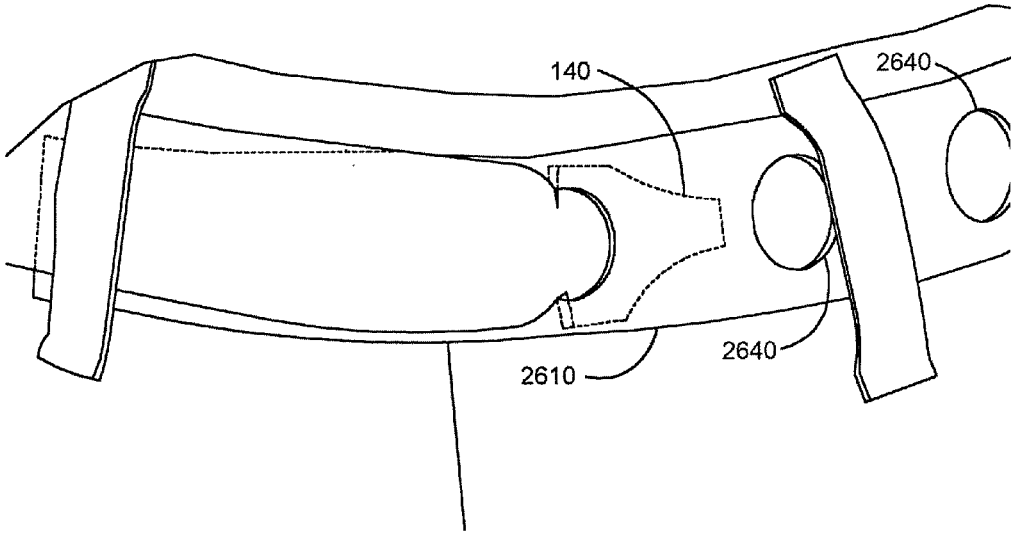
FIG. 26 illustrates an elastomeric fastener configured for use as a belt, according to various embodiments of the invention.

FIG. 26 illustrates embodiments of Elastomeric Fastener 100 configured for use as a Belt 2610. Locking Mechanism 140 is included in Belt 2610 and is configured to attach to a plurality of alternative Openings 2640.

Figure 27:
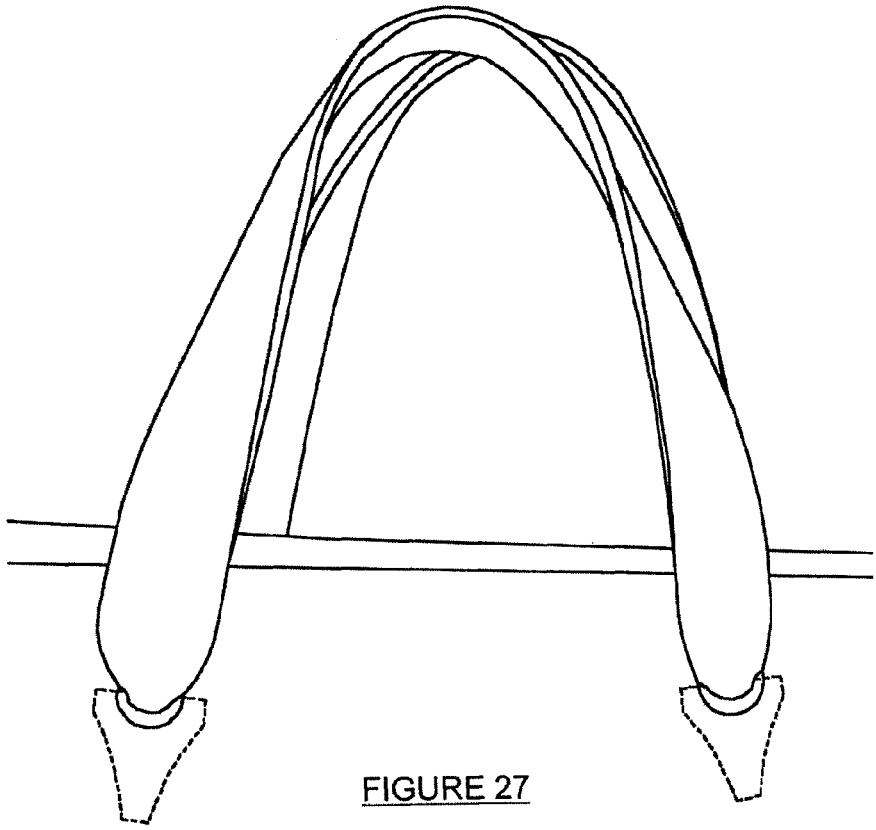
FIG. 27 illustrates an elastomeric fastener configured for use as a bag handle, according to various embodiments of the invention.

FIG. 27 illustrates various embodiments of Elastomeric Fastener 100 configured for use as a bag handle, according to various embodiments of the invention. The bag may include a shopping bag, a purse, a briefcase, or the like.

Figure 28:
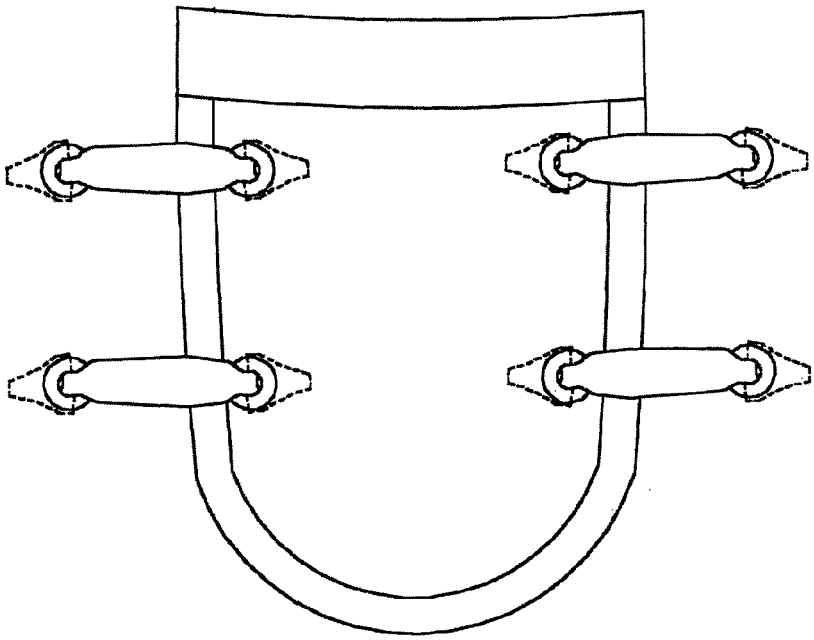
FIG. 28 illustrates an elastomeric fastener configured for use with clothing, according to various embodiments of the invention.

FIG. 28 illustrates various embodiments of Elastomeric Fastener 100 configured for use with clothing. In these embodiments, Elastomeric Fastener 100 may be used in place of buttons, zippers, snaps, or the like. The use of elastomeric fasteners may replace the need for glue or stitching in some areas of the garment as well, and may allow for addition customization by means of swapping out portions of the garment and re-fastening new portions using elastomeric fasteners.

Figure 29:
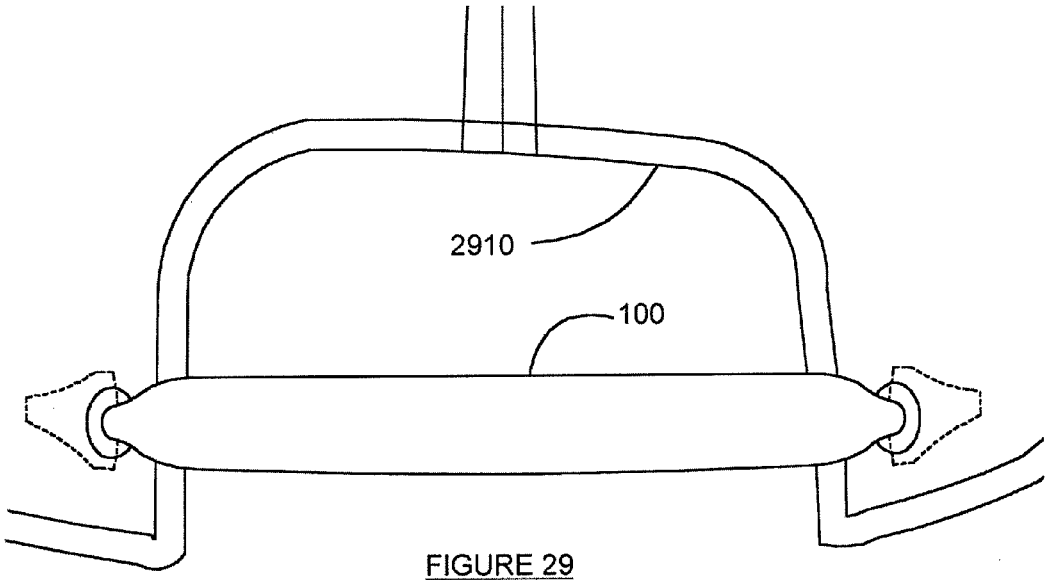
FIG. 29 illustrates an elastomeric fastener configured for use with a hat, according to various embodiments of the invention.

FIG. 29 illustrates various embodiments of Elastomeric Fastener 100 configured for use with a Hat 2910. FIG. 29 illustrates the back of Hat 2910 in which Elastomeric Fastener 100 is configured to adjust the size of Hat 2910.

Figure 30:
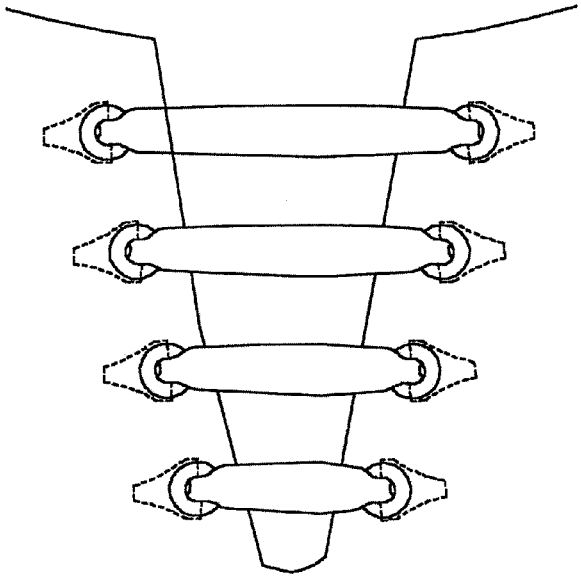
FIG. 30 illustrates an elastomeric fastener configured for use as a clothing closure, according to various embodiments of the invention.

FIG. 30 illustrates various embodiments of Elastomeric Fastener 100 configured for use as a clothing closure.

Figure 31:
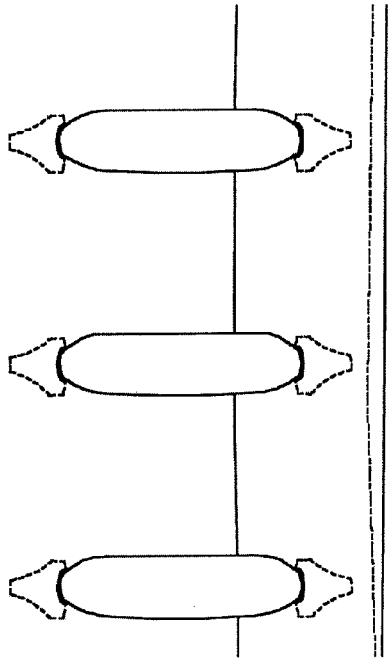
FIG. 31 illustrates an alternative elastomeric fastener configured for use as a clothing closure, according to various embodiments of the invention.

FIG. 31 illustrates various further embodiments of Elastomeric Fastener 100 configured for use as a clothing closure.

Several embodiments are specifically illustrated and/or described herein. However, it will be appreciated that modifications and variations are covered by the above teachings and within the scope of the appended claims, without departing from the spirit and intended scope thereof.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. An elastomeric fastener system comprising:

a body including an elastomeric material configured to stretch so as to secure an article of footwear to a foot;

a first locking mechanism disposed at a first end of the body and configured to attach to the article of footwear, the body including a curved portion in contact with the first locking mechanism at an angle greater than ten degrees; and a second locking mechanism disposed at a second end of the body and configured to be attached and detached from the article of footwear by a user by passing the second locking mechanism through an opening in the footwear, wherein the second locking mechanism locks into place because it expands once it has passed fully through the opening.

2. The elastomeric fastener system of claim 1, wherein the second locking mechanism includes a hook or slot configured to receive a hook.

3. The elastomeric fastener system of claim 1, further including the article of footwear.

4. The elastomeric fastener system of claim 3, wherein the article of footwear includes a boot.

5. The elastomeric fastener system of claim 3, wherein the article of footwear includes a sandal.

6. The elastomeric fastener system of claim 1, wherein the first locking mechanism is permanently attached to the article of footwear.

7. The elastomeric fastener system of claim 1, wherein the second locking mechanism and the body are of the same material.

8. The elastomeric fastener system of claim 1, wherein the body includes an image or text disposed to be visible when the second locking mechanism is attached to the article of footwear.

9. The elastomeric fastener system of claim 1, further including a third locking mechanism attached to the body and configured to be attached and detached from the article of footwear by a user.

10. The elastomeric fastener system of claim 1, wherein the first locking mechanism includes a first surface, a second surface and a plurality of edge surfaces, the curved portion being in greater contact with the first surface relative to any of the plurality of edge surfaces.

11. The elastomeric fastener of claim 1, wherein the curved portion is in contact with the first locking mechanism.

12. The elastomeric fastener system of claim 1, wherein the first locking mechanism includes a triangular arrow configured to pass through the opening in the footwear.

13. The elastomeric fastener system of claim 1, wherein the first locking mechanism extends past the curved portion towards a location of the attachment of the first locking mechanism to the article of footwear.

14. The elastomeric fastener system of claim 1, wherein the curved portion includes a curve down transition point from the first end of the body to the body itself.

15. The elastomeric fastener system of claim 1, wherein the curved portion is in contact with the first locking mechanism at an angle greater than thirty-five degrees.

16. The elastomeric fastener system of claim 1, wherein the body includes a light.

17. The elastomeric fastener system of claim 1, wherein the body includes a light.

18. The elastomeric fastener system of claim 1, wherein the body includes a writable surface.

19. An elastomeric fastener system for securing an article of clothing having a first coupling point and a second coupling point, the system comprising:

a body including an elastomeric material, the body having a first end and a second end that are offset from the body;

a first locking mechanism associated with the first end of the body; and a second locking mechanism associated with the second end of the body, the first and second locking mechanisms being disposed below an upper surface of the body;

wherein the first locking mechanism is capable of being passed through the first coupling point and the second locking mechanism is capable of being passed through the second coupling point, the body is capable of being positioned entirely above an outer surface of the article of clothing and is capable of exerting a tensile force on the first coupling point and the second coupling point to secure the article of clothing.

20. The elastomeric fastener system of claim 19, wherein the first locking mechanism is a deformable elastomeric member which is configured to be attached and detached from the article of clothing by a user deforming the first locking mechanism before passing the same through the first coupling point, and wherein the second locking mechanism is a deformable elastomeric member.

21. The elastomeric fastener system of claim 19, wherein the article of clothing is a shoe, and wherein the body is configured to lay flat across when extending across an upper of the shoe between the first coupling point and the second coupling point.

22. An elastomeric fastener system comprising:

a first elastomeric fastener comprising a first body including an elastomeric material configured to stretch so as to secure an article of footwear to a foot, a first locking mechanism attached to the first body and configured to attach to the article of footwear, and a second locking mechanism attached to the first body and configured to be attached and detached from the article of footwear by a user, the second locking mechanism including an arrow, the first and second locking mechanisms being disposed below an upper surface of the first body; and a second elastomeric fastener comprising a second body including an elastomeric material configured to stretch so as to secure the article of footwear to a foot, a third locking mechanism attached to the second body and configured to attach to the article of footwear, and a fourth locking mechanism attached to the second body and configured to be attached and detached from the article of footwear by the user by passing the second locking mechanism through an opening in the footwear, the third and fourth locking mechanisms being disposed below an upper surface of the second body.

23. The elastomeric fastener system of claim 22, further including an image configured to be displayed using the first body and the second body.

24. The elastomeric fastener system of claim 22, wherein the first body includes a first pattern and the second body includes a second pattern, the first pattern and the second pattern configured to form an image in combination.

25. The elastomeric fastener system of claim 22, wherein the first body includes an edge configured to conform with an edge of the second body.

26. The elastomeric fastener system of claim 25, wherein the edge of the first body has a different shape than the edge of the second body.

27. An elastomeric fastener system comprising:

a first elastomeric fastener comprising a first body including an elastomeric material configured to stretch so as to secure an article of footwear to a foot, and including a first part of an image, the first body having rounded edges;

a first locking mechanism including a hook-and-loop fastening system, the hook-and-loop fastening system attached to the first body and attached to an outer surface of a first side of an upper of the article of footwear, and a second locking mechanism including a hook-and-loop fastening system, the hook-and-loop fastening system attached to the first body and attached to an outer surface of a second side of the upper of the article of footwear; and a second elastomeric fastener comprising a second body including an elastomeric material configured to stretch so as to secure the article of footwear to the foot, and including a second different part of the image, the second body having rounded edges, a third locking mechanism attached to the second body and configured to attach to the article of footwear, and a fourth locking mechanism attached to the second body and configured to be attached and detached from the article of footwear by the user by passing the fourth locking mechanism through an opening in the footwear.

28. An elastomeric fastener system for securing together a first section and a second section of a footwear, the system comprising:

an elastomeric body having a first resilient locking member disposed on a first end and attachable to a first section of the footwear and a second resilient locking member disposed on a second end, the first and second resilient locking members being disposed below an upper surface of the elastomeric body; and wherein when the first resilient locking member is passed through a first opening formed in the first section of the footwear and when the second resilient locking member is passed through a second opening formed in the second section of the footwear, the first resilient locking member engages with the first opening and the second resilient locking member engages with the second opening to create tensile forces in the elastomeric body that urge the first and second sections of the footwear towards one another to secure the footwear around at least a portion of a foot of an individual.

29. The elastomeric fastener system of claim 28, wherein the first and second resilient locking members are positioned below and offset from the elastomeric body, and the elastomeric body is flat.

30. The elastomeric fastener system of claim 28, wherein the first and second resilient locking members are substantially non-parallel and non-coplanar relative to the elastomeric body.

31. The elastomeric fastener system of claim 28, wherein the first resilient locking member is fixedly attached to the first section of the footwear.

32. The elastomeric fastener system of claim 28, wherein an upper surface of the second resilient locking member contacts a lower surface of the second section of the footwear.

33. The elastomeric fastener system of claim 28, wherein the elastomeric body includes an image or text disposed to be visible when the second resilient locking member is attached to the second section of the footwear.

34. The elastomeric fastener system of claim 28, further including a third locking member attached to the elastomeric body and releasably associable with an additional section of the footwear.

35. The elastomeric fastener system of claim 28, further including the footwear.

36. An elastomeric fastener, comprising:

a first elastomeric locking mechanism;

a second elastomeric locking mechanism; and a body extending between the first and second elastomeric locking mechanisms, the body having a length such that the body extends only between laterally adjacent eyelets of an article of footwear and urges the laterally adjacent eyelets towards one another, wherein the first and second elastomeric locking mechanisms are disposed below an upper surface of the body.

37. An elastomeric fastener, comprising:

an elastomeric body having opposing terminal ends; and two identical elastomeric locking mechanisms that are each resiliently biased at an upward angle relative to the elastomeric body, each of the two identical elastomeric locking mechanisms extending past one of the opposing terminal ends of the elastomeric body, wherein the two identical elastomeric locking mechanisms are disposed below an upper surface of the body.

38. An elastomeric fastener for an article of footwear, the article of footwear comprising at least four eyelets, a first and third eyelet disposed along a first longitudinal axis, and a second and fourth eyelet disposed along a second longitudinal axis, the first and second longitudinal axes being disposed substantially parallel to one another, the fastener comprising:

a first elastomeric locking mechanism that passes through the first eyelet;

a second elastomeric locking mechanism that passes through the second eyelet; and an elastomeric body that exerts tensional forces on the first and second elastomeric locking mechanisms, which, in turn, exert tensional forces on the first and second eyelets, wherein the first and second elastomeric locking mechanisms are disposed below an upper surface of the elastomeric body.

* * * * *